US010941790B2

(12) United States Patent
Arai

(10) Patent No.: US 10,941,790 B2
(45) Date of Patent: Mar. 9, 2021

(54) CYLINDER DEVICE, PRESS MACHINE, WORKPIECE CLAMPING APPARATUS, CYLINDER DEVICE ACTUATING METHOD, METHOD FOR CLAMPING WORKPIECE, AND METHOD FOR PRESSING WORKPIECE

(71) Applicant: Seiko Instruments Inc., Chiba (JP)

(72) Inventor: Shigehiro Arai, Chiba (JP)

(73) Assignee: Seiko Instruments Inc., Chiba (JP)

( * ) Notice: Subject to any disclaimer, the term of this patent is extended or adjusted under 35 U.S.C. 154(b) by 390 days.

(21) Appl. No.: 15/921,973

(22) Filed: Mar. 15, 2018

(65) Prior Publication Data

US 2018/0266445 A1 Sep. 20, 2018

(30) Foreign Application Priority Data

Mar. 15, 2017 (JP) ..... 2017-049311
Feb. 9, 2018 (JP) ..... 2018-021722

(51) Int. Cl.
*F15B 3/00* (2006.01)
*B21D 22/20* (2006.01)
(Continued)

(52) U.S. Cl.
CPC ..... *F15B 3/00* (2013.01); *B21D 22/205* (2013.01); *B21D 28/005* (2013.01); *B30B 1/38* (2013.01);
(Continued)

(58) Field of Classification Search
CPC ..... B30B 1/32; B30B 15/161; B30B 15/165; B30B 15/168; B30B 1/38; F15B 3/00;
(Continued)

(56) References Cited

U.S. PATENT DOCUMENTS 3,511,048 A * 5/1970 Nemetz ..... F15B 11/0325 60/565
4,395,027 A * 7/1983 Nordmeyer ..... F15B 11/0325 269/25
(Continued)

FOREIGN PATENT DOCUMENTS

JP 4895342 B2 3/2012

*Primary Examiner* — Shelley M Self
*Assistant Examiner* — Jared O Brown
(74) *Attorney, Agent, or Firm* — Brinks Gilson & Lione

(57) ABSTRACT

A pneumatic chamber 20 is configured to include a first pneumatic chamber 21 pressurizing a first piston 11 and a second pneumatic chamber 22 pressurizing a second piston 12. The first pneumatic chamber 21 and the second pneumatic chamber 22 communicate with each other through a communication hole 87 formed via the inside of a retaining bolt 17. The second pneumatic chamber 22 is formed in a hydraulic pressure generating unit 55 moving in a thrust direction in a cylinder 2 and is separable from the first pneumatic chamber 21. In addition, the communication hole 87 is also separated into a communication hole 87*a* and a communication hole 87*b* with the corresponding separation, a rod portion 50 of the first piston 11 is also separated into a rod portion 50*a* and a rod portion 50*b*, and the communication hole 87*b* and the rod portion 50*b* are formed to be movable along with the hydraulic pressure generating unit 55 in the thrust direction.

28 Claims, 14 Drawing Sheets

(51) Int. Cl.

| | |
|---|---|
| ***B30B 1/38*** | (2006.01) |
| ***B21D 24/00*** | (2006.01) |
| ***B21D 28/00*** | (2006.01) |
| ***B30B 15/16*** | (2006.01) |
| *B21D 22/22* | (2006.01) |

(52) U.S. Cl.
CPC ..... *B30B 15/165* (2013.01); *B21D 22/22* (2013.01); *B21D 24/005* (2013.01)

(58) Field of Classification Search
CPC ..... F15B 2211/7055; B21D 22/205; B21D 24/005; B23P 19/027
USPC ..... 91/4 R
See application file for complete search history.

(56) References Cited

U.S. PATENT DOCUMENTS 4,633,758 A * 1/1987 Kedzierski ..... F15B 15/227 91/44
4,841,846 A * 6/1989 Grambling ..... E21B 37/10 277/434
4,993,226 A * 2/1991 De Kok ..... F15B 11/0325 60/547.1
5,377,488 A * 1/1995 Malina ..... F15B 11/0325 60/560
5,582,009 A * 12/1996 Brieschke ..... F15B 3/00 60/560
5,649,424 A * 7/1997 Valavaara ..... F15B 3/00 60/560
5,865,029 A * 2/1999 Brieschke ..... F15B 11/032 60/560
6,735,944 B2 * 5/2004 Sawdon ..... B21J 15/22 60/560
6,779,343 B2 * 8/2004 Sawdon ..... B21J 15/22 60/560
2006/0073037 A1 * 4/2006 Pedersen ..... F15B 3/00 417/415
2010/0121496 A1 * 5/2010 Paulus ..... F15B 9/09 700/282
2015/0075157 A1 * 3/2015 Gresser ..... F15B 11/032 60/560

* cited by examiner (a)

(a)

(1) RETREATING (2) AIR DRIVE (3) HYDRAULIC DRIVE (4) AIR DRIVE (b)

(1) RETREATING (2) AIR DRIVE (3) HYDRAULIC DRIVE (4) AIR DRIVE (c)

(1) RETREATING (2) AIR DRIVE (3) HYDRAULIC DRIVE (4) AIR DRIVE (a)

(b)

(c)

(d)

CYLINDER DEVICE, PRESS MACHINE, WORKPIECE CLAMPING APPARATUS, CYLINDER DEVICE ACTUATING METHOD, METHOD FOR CLAMPING WORKPIECE, AND METHOD FOR PRESSING WORKPIECE

RELATED APPLICATIONS

This application claims priority under 35 U.S.C. § 119 to Japanese Patent Application Nos. 2017-049311 filed Mar. 15, 2017 and 2018-021722 filed Feb. 9, 2018, the entire content of which are hereby incorporated by reference.

BACKGROUND OF THE INVENTION

Field of the Invention

The present invention relates to a cylinder device, a press machine, a workpiece clamping apparatus, a cylinder device actuating method, a method for clamping workpiece, and a method for pressing workpiece, such as a technology in which a fluid pressure cylinder is used.

Background Art

A fluid pressure cylinder using a fluid such as air (a gas) or oil (a liquid) is used in many industrial fields.

The fluid pressure cylinder generates thrust on a piston in a cylinder due to pressure of a fluid such that the thrust can be a drive force of various types of mechanical actuation such as driving of a press or an actuator.

However, a hydraulic cylinder has a characteristic in that even a small hydraulic cylinder generates large thrust due to a high pressure force by hydraulic pressure; however, a problem arises in that large-scale equipment such as a hydraulic pressure supply device is required.

Therefore, Japanese Patent No. 4895342 proposes a fluid pressure cylinder that generates hydraulic pressure with air pressure by an air hydraulic cylinder obtained by combining an air cylinder and a hydraulic cylinder such that a complex hydraulic system is omitted and the fluid pressure cylinder can be decreased in costs and size.

However, in a technology in Japanese Patent No. 4895342, the thrust is generated by a movement distance of a piston of the air cylinder with a sectional area of the hydraulic cylinder, and thus a problem of a short stroke arises.

For example, in a case where an actuator is disposed on an output side of the air hydraulic cylinder, it is necessary to cause the actuator to move along with the air hydraulic cylinder in order to secure a stroke.

SUMMARY OF THE INVENTION

According to an aspect of the invention, an object thereof is to provide a cylinder device having a long stroke by using an air hydraulic cylinder.

According to a first aspect of the invention, in order to achieve the object described above, there is provided a cylinder device including: a cylinder; a hydraulic chamber that moves in a thrust direction in the cylinder; a transfer pneumatic chamber that is formed in the cylinder and transfers the hydraulic chamber from one end side to the other end side; a pressurizing pneumatic chamber that is formed in the cylinder and pressurizes the transferred hydraulic chamber; fixing means for generating a force in a radial direction from a force in a thrust direction, which is applied to the hydraulic chamber through the pressurization by the pressurizing pneumatic chamber, and fixing the hydraulic chamber in the cylinder due to the force in the radial direction; hydraulic pressure amplifying means for amplifying hydraulic pressure that is generated in the fixed hydraulic chamber through the pressurization by the pressurizing pneumatic chamber; and an output rod that outputs the amplified hydraulic pressure.

According to a second aspect of the invention, in the cylinder device of the first aspect, the hydraulic chamber may generate hydraulic pressure by receiving a force in a direction to the other end side, which is applied to the hydraulic chamber through the pressurization by the pressurizing pneumatic chamber, and a force in a direction to the one end side, which is applied to the hydraulic chamber by the output rod.

According to a third aspect of the invention, in the cylinder device of the first or second aspect, the hydraulic chamber may be configured to include a first hydraulic chamber provided with the output rod and a second hydraulic chamber provided with the fixing means, the fixing means may fix the second hydraulic chamber and the first hydraulic chamber by generating the force in the radial direction due to hydraulic pressure of the second hydraulic chamber, and the hydraulic pressure amplifying means may amplify hydraulic pressure generated in the first hydraulic chamber and may output the hydraulic pressure to the output rod.

According to a fourth aspect of the invention, in the cylinder device of the third aspect, the fixing means may fix the second hydraulic chamber and the first hydraulic chamber by pressing, to an inner wall of the cylinder, a side wall of the second hydraulic chamber that is elastically deformed due to the force in the radial direction.

According to a fifth aspect of the invention, in the cylinder device of the third aspect, the fixing means may generate the force in a radial direction by pressing, to a clamper, a taper member moving in a thrust direction due to hydraulic pressure generated in the second hydraulic chamber, and may fix the second hydraulic chamber and the first hydraulic chamber by pressing the clamper to an inner wall of the cylinder by the force.

According to a sixth aspect of the invention, in the cylinder device of the third, fourth, or fifth aspect, the first hydraulic chamber may have an output piston pressing the output rod in an output direction, the cylinder device further including: biasing means that biases the output piston in a direction opposite to the output direction.

According to a seventh aspect of the invention, in the cylinder device of the sixth aspect, the output piston of the first hydraulic chamber may transmit only an output to the output rod without moving even in a state in which hydraulic pressure generated by being amplified in the first hydraulic chamber is applied to the output rod and thrust is output.

According to an eighth aspect of the invention, in the cylinder device of any one of the third to seventh aspects, the pressurizing pneumatic chamber may be configured to include a first pneumatic chamber having a first piston that pressurizes the first hydraulic chamber, a second pneumatic chamber having a second piston that pressurizes the second hydraulic chamber, and a communication hole through which the first pneumatic chamber communicates with the second pneumatic chamber. The first pneumatic chamber may have a first inlet/outlet and may be formed on the one end side of the second pneumatic chamber.

According to a ninth aspect of the invention, in the cylinder device of the eighth aspect, the first piston may cause the second pneumatic chamber, the first hydraulic chamber, and the second hydraulic chamber to move to the other end side until the output rod abuts on a pressing target or until the first hydraulic chamber reaches an end portion on the other end side to which the first hydraulic chamber is movable, with pressure of the first pneumatic chamber.

According to a tenth aspect of the invention, in the cylinder device of the ninth aspect, a movement distance of the second piston measured when the second piston of the second hydraulic chamber generates hydraulic pressure amplified in the second hydraulic chamber may be within a range of a length of elastic deformation of a seal member of the second hydraulic chamber, which is disposed in the second piston.

According to an eleventh aspect of the invention, in the cylinder device of the ninth or tenth aspect, the first hydraulic chamber may be formed on the other end side of the second hydraulic chamber, and the first piston may be formed up to the first hydraulic chamber by penetrating through the second pneumatic chamber and the second hydraulic chamber.

According to a twelfth aspect of the invention, in the cylinder device of the eleventh aspect, the communication hole and a piston rod of the first piston may be configured to be separable between the first pneumatic chamber and the second pneumatic chamber, and the transfer pneumatic chamber may be formed between the first pneumatic chamber and the second pneumatic chamber and separates the second pneumatic chamber from the first pneumatic chamber so as to transfer the second pneumatic chamber along with the first hydraulic chamber and the second hydraulic chamber to the other end side.

According to a thirteenth aspect of the invention, in the cylinder device of the twelfth aspect, the communication hole may be formed to penetrate through the first piston, and the first pneumatic chamber may transfer the first piston to the side of the separated second pneumatic chamber such that the separated communication holes are joined to each other and the separated piston rods of the first piston are joined to each other.

According to a fourteenth aspect of the invention, in the cylinder device of the thirteenth aspect, the communication hole may have a valve mechanism in a separating portion, and the valve mechanism may stop circulation from the transfer pneumatic chamber formed between the first pneumatic chamber and the second pneumatic chamber to the second pneumatic chamber when the communication holes are separated from each other and causes the circulation to be performed between the first pneumatic chamber and the second pneumatic chamber when the communication holes are joined to each other.

According to a fifteenth aspect of the invention, the cylinder device of the thirteenth or fourteenth aspect may further include a second inlet/outlet formed on the one end side in the cylinder; and a transfer inlet/outlet channel that communicates with the second inlet/outlet and the transfer pneumatic chamber, is formed inside the first piston and the piston rod of the first piston, and elongates and contracts depending on the movement of the first piston.

According to a sixteenth aspect of the invention, in the cylinder device of the fifteenth aspect, the transfer inlet/outlet channel may elongate and contract in the cylinder.

According to a seventeenth aspect of the invention, in the cylinder device of the fifteenth aspect, the transfer inlet/outlet channel may extend to the outside of the cylinder and may elongate and contract with an extending portion sliding inside and outside the cylinder.

According to an eighteenth aspect of the invention, the cylinder device of the fifteenth, sixteenth, or seventeenth aspect may further include: a third pneumatic chamber that is provided on the other end side in the cylinder, has a third inlet/outlet, and presses the hydraulic chamber to the one end side.

According to a nineteenth aspect of the invention, there is provided a press machine including: the cylinder device according to the eighteenth aspect having an output rod on which a tool is disposed; workpiece mounting means for mounting a workpiece at a predetermined position with respect to the cylinder device; press means for pressing the mounted workpiece with the tool by driving the cylinder device; and detachment means for detaching the pressed workpiece from the predetermined position.

According to a twentieth aspect of the invention, there is provided a workpiece clamping apparatus including: the cylinder device according to the eighteenth aspect having an output rod on which a tool is disposed; workpiece mounting means for mounting a workpiece at a predetermined position with respect to the cylinder device; means for pressing and clamping the mounted workpiece with the tool by driving the cylinder device; and detachment means for detaching the clamped workpiece from the predetermined position.

According to a twenty-first aspect of the invention, there is provided a cylinder device actuating method for actuating the cylinder device according to the eighteenth aspect, the method including: a first step of setting an initial state by causing the first hydraulic chamber and the second hydraulic chamber to move to one end side by pressurizing the third inlet/outlet and depressurizing the first inlet/outlet and the second inlet/outlet; a second step of causing the output rod to abut on a pressing target or causing the first hydraulic chamber to reach an end portion on the other end side to which the first hydraulic chamber is movable by causing the first pneumatic chamber and the second pneumatic chamber to move to the other end side by pressurizing the first pneumatic chamber and the second pneumatic chamber from the first inlet/outlet and depressurizing the third pneumatic chamber from the second inlet/outlet; a third step of fixing the first hydraulic chamber and the second hydraulic chamber to the cylinder by actuating fixing means by depressurizing the second inlet/outlet and the third inlet/outlet and pressurizing the first inlet/outlet so as to pressurize the second pneumatic chamber; a fourth step of pressing the output rod to a pressing target by further performing pressurization from the first inlet/outlet and actuating hydraulic pressure amplifying means; and a fifth step of returning to the initial state by causing the first hydraulic chamber and the second hydraulic chamber to move to the one end side by depressurizing the first inlet/outlet and the second inlet/outlet and pressurizing the third inlet/outlet.

According to a twenty-second aspect of the invention, there is provided a method for pressing a workpiece by actuating the press machine according to the nineteenth aspect, the method including: a first step of driving the cylinder device and returning a position of the output rod to an initial state; a second step of mounting the workpiece at a predetermined position; a third step of driving the cylinder device and causing the cylinder device to move due to pneumatic pressure until a tool disposed on the output rod abuts and stops on the workpiece; a fourth step of fixing the first hydraulic chamber and the second hydraulic chamber by the fixing means; a fifth step of amplifying hydraulic pressure of the first hydraulic chamber by the hydraulic pressure amplifying means; a sixth step of pressing the workpiece due to hydraulic pressure with a tool disposed on the output rod, due to the hydraulic pressure amplified in the fifth step, and pressing the workpiece; a seventh step of driving the cylinder device and detaching the output rod and the tool disposed on the output rod from the workpiece due to pneumatic pressure; and an eighth step of detaching the completely pressed workpiece from the predetermined position.

According to a twenty-third aspect of the invention, there is provided a method for clamping a workpiece at a predetermined position by actuating the workpiece clamping apparatus according to the twentieth aspect, the method including: a first step of mounting the workpiece at the predetermined position; a second step of driving the cylinder device and causing the cylinder device to move due to pneumatic pressure until the tool disposed on the output rod abuts and stops on the workpiece; a third step of fixing the first hydraulic chamber and the second hydraulic chamber by the fixing means; a fourth step of amplifying hydraulic pressure of the first hydraulic chamber by the hydraulic pressure amplifying means; and a fifth step of clamping the workpiece at a predetermined position by pressing the workpiece with the tool disposed on the output rod due to the hydraulic pressure amplified in the fourth step.

According to a twenty-fourth aspect of the invention, the cylinder device of the first aspect may further include: an input-side housing that moves in the thrust direction in the cylinder and an output-side housing that is separated from the input-side housing to be disposed on the other end side, the hydraulic chamber may be configured to include a first hydraulic chamber that is disposed in the output-side housing and is provided with the output rod and a second hydraulic chamber that is disposed in the input-side housing and is provided with the fixing means, the pressurizing pneumatic chamber may be configured to include a first pneumatic chamber having a first piston that pressurizes the first hydraulic chamber and a second pneumatic chamber having a second piston that pressurizes the second hydraulic chamber, and the transfer pneumatic chamber may be disposed between the first hydraulic chamber and the second hydraulic chamber so as to transfer the first hydraulic chamber from the one end side to the other end side.

According to a twenty-fifth aspect of the invention, in the cylinder device of the twenty-fourth aspect, the second piston may have a rod portion that moves to the other end side due to pressure from the second pneumatic chamber and pressurizes the second hydraulic chamber due to the movement, the fixing means may fix the second hydraulic chamber by generating the force in the radial direction due to hydraulic pressure of the second hydraulic chamber that is pressurized by the rod portion, the second hydraulic chamber may be fixed by the fixing means and, then, may restrict the first hydraulic chamber from moving to the one end side, and the hydraulic pressure amplifying means may amplify the hydraulic pressure generated in the first hydraulic chamber and may output the amplified hydraulic pressure to the output rod.

According to a twenty-sixth aspect of the invention, the cylinder device of the twenty-fourth or twenty-fifth aspect may further include: a first inlet/outlet for pressurizing the second pneumatic chamber; and a third inlet/outlet for pressurizing the transfer pneumatic chamber by penetrating through the second pneumatic chamber and the second hydraulic chamber.

According to a twenty-seventh aspect of the invention, in the cylinder device of the twenty-fourth, twenty-fifth, or twenty-sixth aspect, the second piston may have a rod portion that moves to the other end side due to pressure from the second pneumatic chamber and pressurizes the second hydraulic chamber due to the movement.

According to a twenty-eighth aspect of the invention, in the cylinder device of the twenty-seventh aspect, the third inlet/outlet may have an inlet/outlet rod that is fixed to the second piston, penetrates through the second piston and the rod portion, and penetrates through the second pneumatic chamber and the second hydraulic chamber so as to pressurizes the transfer pneumatic chamber. The cylinder device may further include: a valve mechanism that is disposed on a communication channel, through which the transfer pneumatic chamber and the first pneumatic chamber are connected to each other, and is opened and closed in association with movement of the inlet/outlet rod moving along with the second piston, and the third inlet/outlet may pressurize the transfer pneumatic chamber when the valve mechanism is in a closed state and may pressurize the first pneumatic chamber when the valve mechanism is in an opened state.

According to a twenty-ninth aspect of the invention, there is provided a cylinder device actuating method for actuating the cylinder device of the twenty-eight aspect, the method including: a first movement stopping step of stopping the movement of the output-side housing by pressurizing the transfer pneumatic chamber and causing the output-side housing to move to the other end side and the output rod to abut on a pressing target or causing an output-side end portion of the output-side housing to abut on an end portion of the cylinder on the other side; a second movement stopping step of causing the second piston and the input-side housing to move to the other end side and stopping the movement with abutment on the output-side housing by pressurizing the second pneumatic chamber from the first inlet/outlet; a fixing step of actuating the fixing means by pressurizing the second hydraulic chamber from the first inlet/outlet so as to cause the second piston to further move to the other end side such that the rod portion pressurizes the second hydraulic chamber of the input-side housing subjected to the stopping of the movement, fixing the input-side housing and the output-side housing to the cylinder, and causing the valve mechanism to come into the opened state; and a thrust generating step of actuating the hydraulic pressure amplifying means by pressurizing the first pneumatic chamber from the third inlet/outlet through the valve mechanism being in the opened state and generating thrust due to the hydraulic pressure amplified from the front end of the output rod.

According to the invention, the movement of the hydraulic chamber in the cylinder by the pneumatic chamber enables both of the stroke and the thrust to be secured.

DETAILED DESCRIPTION OF THE INVENTION

Outline of First Embodiment

Figures 1A, 1B, 1C:
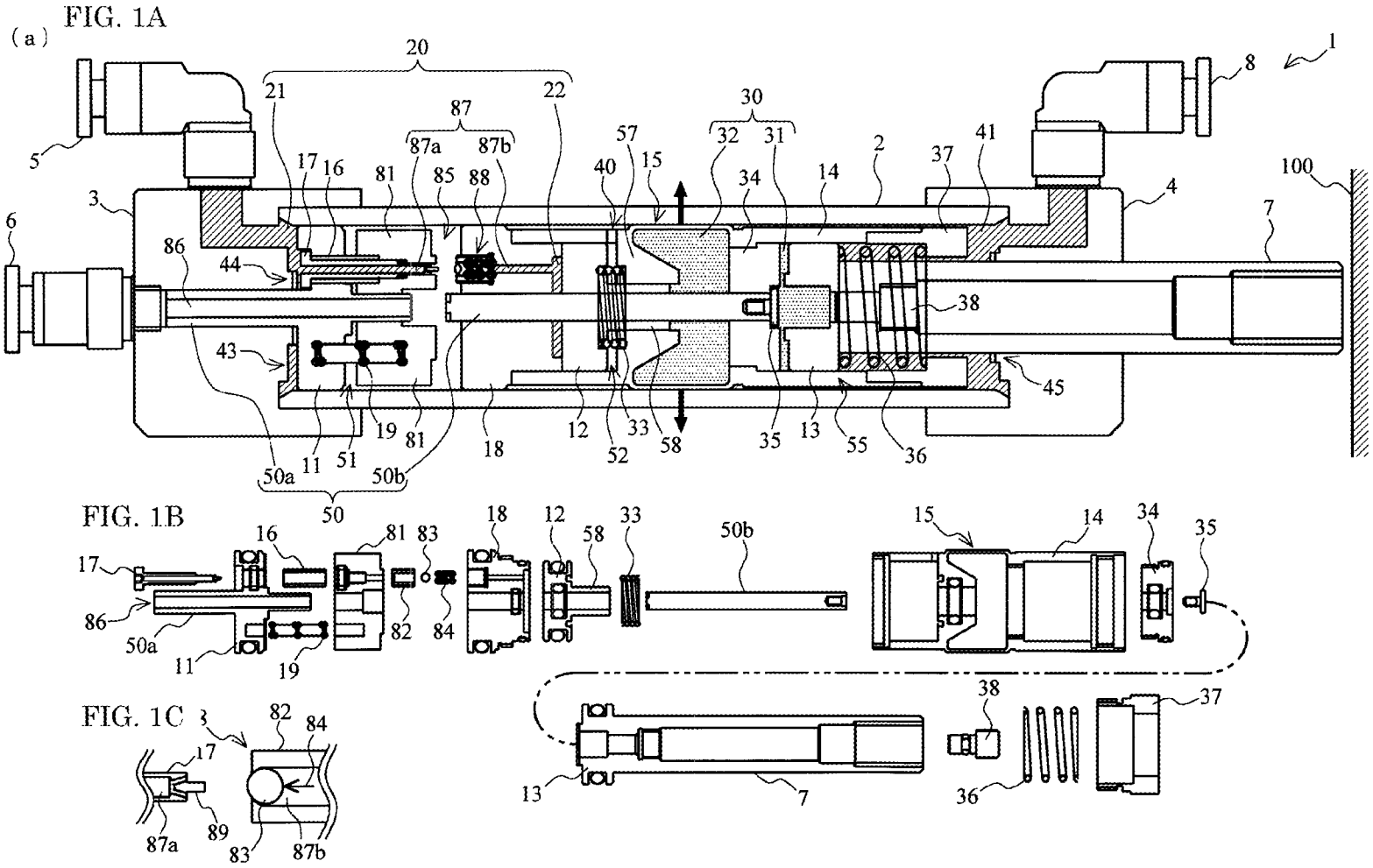
FIGS. 1A to 1C are views for illustrating a first embodiment.

An air hydraulic cylinder in the related art is characterized in that an air cylinder unit has a long stroke and low thrust are generated in an air cylinder portion and a hydraulic cylinder unit has a short stroke and high thrust are generated in a hydraulic cylinder portion.

By comparison, in a cylinder device 1 (FIG. 1A) of the embodiment, a hydraulic chamber 30 moves in a thrust direction in a cylinder 2 and a pneumatic chamber 20 pressurizes the hydraulic chamber 30 after the moving and generates hydraulic pressure. In this manner, a necessary stroke is secured and necessary thrust is generated.

More specifically, the pneumatic chamber 20 is configured to include a first pneumatic chamber 21 pressurizing a first piston 11 and a second pneumatic chamber 22 pressurizing a second piston 12.

The first pneumatic chamber 21 and the second pneumatic chamber 22 are in communication with each other through a communication hole 87 formed via the inside of a retaining bolt 17.

The second pneumatic chamber 22 is formed in a hydraulic pressure generating unit 55 moving in a thrust direction in a cylinder 2 and is separable from the first pneumatic chamber 21.

In addition, the communication hole 87 is also separated into a communication hole 87*a* and a communication hole 87*b* with the corresponding separation, a rod portion 50 of the first piston 11 is also separated into a rod portion 50*a* and a rod portion 50*b*, and the communication hole 87*b* and the rod portion 50*b* are formed to be movable along with the hydraulic pressure generating unit 55 in the thrust direction.

The hydraulic pressure generating unit 55 is internally provided with a hydraulic chamber 30, in addition to the second pneumatic chamber 22, and the hydraulic chamber 30 is configured to have a first hydraulic chamber 31 pressurized by the first pneumatic chamber 21 via the first piston 11 and a second hydraulic chamber 32 pressurized by the second pneumatic chamber 22 via the second piston 12.

A transfer pneumatic chamber 85 is formed between the hydraulic pressure generating unit 55 and the first pneumatic chamber 21 and transfers the hydraulic pressure generating unit 55 to the side of a third inlet/outlet 8.

The transfer pneumatic chamber 85 is in communication with a second inlet/outlet 6 through a transfer inlet/outlet channel 86 formed in the rod portion 50*a*. When the air is supplied from the second inlet/outlet 6 to the transfer pneumatic chamber 85, the transfer pneumatic chamber 85 presses the hydraulic pressure generating unit 55 and transfers the hydraulic pressure generating unit 55 to the side of the third inlet/outlet 8. In this manner, a sufficient stroke of an output rod 7 is achieved.

The hydraulic pressure generating unit 55 is transferred in a direction to the third inlet/outlet 8 and the output rod 7 abuts on a workpiece 100 in the middle of a stroke thereof, or the hydraulic pressure generating unit 55 abuts on a cylinder end (lid 4).

After the hydraulic pressure generating unit 55 is transferred, the first pneumatic chamber 21 is supplied with the air by a first inlet/outlet 5 and transfers the first piston 11 to the side of the third inlet/outlet 8, and the communication holes 87*a* and 87*b* and the rod portions 50*a* and 50*b* are joined to each other such that the communication hole 87 and the rod portion 50 are restored.

The end surface of the rod portion 50*b* on an input side is provided with a groove, and thereby the transfer pneumatic chamber 85 and the transfer inlet/outlet channel 86 are in communication with each other through the groove even in a state in which the rod portion 50*a* abuts on the rod portion 50*b*.

When the first pneumatic chamber 21 is supplied with the air and has high pressure after the restoration, the pneumatic chamber 22 presses the second piston 12 and hydraulic pressure is generated in the second hydraulic chamber 32. In this manner, a thin portion 15 of the hydraulic chamber 32 is elastically deformed in a radial direction and abuts on an inner wall of the cylinder 2, and the hydraulic pressure generating unit 55 is fixed to the cylinder 2.

Further, when the first pneumatic chamber 21 is supplied with the air and has high pressure, the first piston 11 presses the first hydraulic chamber 31 via the rod portion 50, high hydraulic pressure amplified in this manner is converted into thrust and the thrust is output to the output rod 7.

As described above, the cylinder device 1 achieves both of the long stroke by an air cylinder and high hydraulic pressure by a hydraulic cylinder.

Details of First Embodiment

FIG. 1A is a sectional view in a thrust direction (direction of the centerline) of the cylinder device 1 according to the first embodiment, and FIG. 1B is a view of parts.

In FIG. 1A, an O-ring is omitted for avoiding complicatedness of the figure. The omitted O-ring is disposed between members by which a space is formed and is sealed to contain a fluid such as air or oil. In this manner, the O-ring is provided to seal the space and to prevent leakage of the fluid, and thus, the O-ring is illustrated in the view of parts in FIG. 1B.

The cylinder device 1 is configured to block both opened ends of the cylinder 2 with lids 3 and 4 and accommodates (is internally provided with) the hydraulic pressure generating unit 55 that is movable in the thrust direction inside the cylinder device.

The hydraulic pressure generating unit 55 is an assembly having a hydraulic pressure generating function by being configured to include the second pneumatic chamber 22, the second hydraulic chamber 32, the first hydraulic chamber 31, and the like which are accommodated inside a piston housing 14 as a housing.

The second hydraulic pressure generating unit 55 is transferred to an output side due to the pressure of the transfer pneumatic chamber 85. The hydraulic chamber 32 fixes, in the cylinder 2, the hydraulic pressure generating unit 55 moved due to the hydraulic pressure generated by the second pneumatic chamber 22. The first hydraulic chamber 31 outputs, as the thrust force in a direction to the output rod 7, hydraulic pressure that is amplified from the hydraulic pressure generated inside the first pneumatic chamber 21 and is amplified by the fixing of the hydraulic pressure generating unit 55.

As described above, the cylinder device 1 includes the hydraulic chambers 30 (the first hydraulic chamber 31 and the second hydraulic chamber 32) that move in the thrust direction in the cylinder 2, and the transfer pneumatic chamber 85 that is formed in the cylinder 2 and transfers the corresponding hydraulic chamber 30 from the one end side to the other end side.

Further, the cylinder device 1 includes the pressurizing pneumatic chambers 20 (the first pneumatic chamber 21 and the second pneumatic chamber 22) that are formed in the cylinder 2 and pressurize the transferred hydraulic chamber, fixing means for generating a force in the radial direction, as will be described below, from a force in the thrust direction, which is applied to the hydraulic chamber 30 due to the pressurization by the pressurizing pneumatic chamber 20, and fixing the hydraulic chamber 30 in the cylinder 2 due to the force in the radial direction, hydraulic pressure amplifying means for amplifying hydraulic pressure that is generated in the fixed hydraulic chamber 30 by the pressurization by the pressurizing pneumatic chamber 20, and the output rod 7 that outputs the amplified hydraulic pressure.

A material of parts that configure the cylinder device 1 is metal such as aluminum, stainless steel, or iron.

As an example of the size of the cylinder device 1, an outer diameter is about 20 mm and a stroke length is about 50 mm; however, the size may be larger or smaller than those described above. As described above, the outline of the configuration of the cylinder device 1 is described.

Hereinafter, the one end side, on which the first inlet/outlet 5 is formed, is referred to as an input side because pressurizing air is input on the side, and the other end side, on which the third inlet/outlet 8 is formed, is referred to as the output side because the hydraulic pressure is output on the side.

In addition, a state in which the parts in the cylinder 2 are positioned on the input-most side is referred to as an initial state.

FIG. 1A illustrates a state in which the hydraulic pressure generating unit 55 is transferred from the initial state to the output side.

The cylinder 2 is a circular cylindrical member with both ends opened and configures a housing of the cylinder device 1.

The end portion of the cylinder 2 on the input side is blocked with the lid 3 configured of a circular column-shaped member.

On the output side of the lid 3, a recessed portion 43, into which the cylinder 2 is inserted, is formed, and a male screw formed on the outer circumference of the end portion of the cylinder 2 on the input side is fitted in female threads formed in an inner circumferential surface of the recessed portion 43. In this manner, the cylinder 2 and the lid 3 are screwed and joined to each other.

The recessed portion 43 is provided with a through-hole penetrating along the centerline of the lid 3, and the rod portion 50*a* provided with the transfer inlet/outlet channel 86 therein is slidably inserted in the through-hole from the output side.

In addition, the end surface of the through-hole of the lid 3 on the input side is provided with the second inlet/outlet 6 through which the air is supplied to the transfer pneumatic chamber 85 through the transfer inlet/outlet channel 86.

The rod portion 50*a* is accommodated in the through-hole of the lid 3 in the initial state and is pulled out from the through-hole when the first piston 11 moves to the output side.

As described above, the rod portion 50*a* is configured to elongate or contract in the cylinder 2 and has a length with which the rod portion does not slip out from the through-hole in a case of moving to the output side, without abutting on the second inlet/outlet 6 in a case of moving to the input side.

As described above, the cylinder device 1 includes the second inlet/outlet 6 formed on the one end side (input side) of the cylinder 2 and the transfer inlet/outlet channel 86 that communicates with the second inlet/outlet 6, is formed inside the first piston 11 and the piston rod (rod portion 50*a*), and elongates and contracts depending on the movement of the first piston 11. The transfer inlet/outlet channel 86 elongates and contracts in the cylinder 2.

In a portion of the end portion in the cylinder 2 on the input side, the first piston 11 sliding in the thrust direction along the inner wall of the cylinder 2 is provided.

The end surface of the first piston 11 on the input side is opposite to the bottom surface of the recessed portion 43, and a projecting portion 44 provided with a groove is formed on the bottom surface of the recessed portion 43.

Since the projecting portion 44 restricts a movement range of the first piston 11 to the input side, a space is formed by being surrounded by the recessed portion 43, the end surface of the first piston 11, and the inner wall of the cylinder 2, even in a case where the first piston 11 is positioned near the input-most side.

A side surface of the lid 3 is provided with an inlet/outlet channel that communicates with the space from the first inlet/outlet 5. In this manner, the first pneumatic chamber 21 that can be pressurized and depressurized by intake or exhaust from the first inlet/outlet 5 is formed in the space.

The groove is formed in the projecting portion 44 such that air is rapidly spread all across the end surface of the first piston 11 in a case where the air is supplied from the first inlet/outlet 5.

The end surface on the output side and the end surface on the input side of the first piston 11 are provided with the rod portion 50*a* along the centerline thereof.

As described above, a portion of the rod portion 50*a*, which is formed on the end surface on the input side, is slidably inserted into the through-hole formed in the lid 3.

On the other hand, a portion of the rod portion 50*a*, which is formed on the end surface on the output side, is slidably inserted into the through-hole formed in a joining member 81.

The rod portion 50*a* is internally provided with the transfer inlet/outlet channel 86 formed by the through-hole along the centerline as described above. The transfer inlet/outlet channel 86 communicates with the second inlet/outlet 6 and the transfer pneumatic chamber 85.

The portions formed on the end surfaces on the input side and the output side of the rod portion 50*a* may have a different outer diameter from each other.

The joining member 81, which has a cylindrical shape, is disposed on the output side of the first piston 11. The joining member 81 has an outer diameter that is set to be smaller than an inner diameter of the cylinder 2, and the joining member 81 is movable in the thrust direction without contact with the inner circumference of the cylinder 2.

The end surface of the joining member 81 on the output side is provided with a recessed portion at the center thereof, and the bottom surface of the recessed portion is provided with a through-hole into which the rod portion 50*a* is inserted.

A coil spring 19 is provided between the first piston 11 and the joining member 81 and biases the first piston and the joining member in a direction in which the first piston and the joining member are separated from each other.

The coil spring 19 is disposed in a recessed portion formed at a position corresponding to the end surface of the first piston 11 on the output side and the end surface of the joining member 81 on the input side.

In addition, the first piston 11 is provided with a through-hole for insertion of the retaining bolt 17, and the joining member 81 is provided with a penetrating screw hole for fixing the retaining bolt 17.

A portion of the penetrating screw hole of the joining member 81 on the input side is subjected to counterbore machining, and a collar 16 that is a circular cylindrical member is inserted from the through-hole to the portion subjected to the counterbore machining of the first piston 11.

The retaining bolt 17 is inserted into the collar 16, and the front end of the retaining bolt 17 is fitted and screwed in female threads formed on the joining member 81.

In addition, a portion of the through-hole of the first piston 11 on the input side is subjected to counterbore machining, the head portion of the retaining bolt 17 abuts on the corresponding counterbore portion, and thereby the first piston 11 is prevented from slipping out of the joining member 81.

Although not illustrated, an O-ring is provided between the outer circumferential surface of the collar 16 and the inner circumferential surface of the through-hole of the first piston 11 such that the first piston 11 is slidable with respect to the collar 16 in the thrust direction.

As described above, the coil spring 19 biases the first piston 11 in a separating direction from the joining member 81, and the retaining bolt 17 restricts the maximum separating distance such that the first piston 11 is not separated from the joining member 81 by a distance equal to or longer than a predetermined distance.

The maximum separating distance is set to a distance, with which a gap 51 for securing a stroke by which the first piston 11 is pushed to the side of the joining member 81 is formed between the end surface of the first piston 11 on the output side and the end surface of the joining member 81 on the input side.

With such a configuration described above, in the initial state, the coil spring 19 separates the first piston 11 and the joining member 81 from each other by the distance restricted by the retaining bolt 17; however, when pressure is applied to the first pneumatic chamber 21 after the joining member 81 and a retaining nut 18 to be described below are joined to each other and the hydraulic pressure generating unit 55 is fixed by the thin portion 15, the first piston 11 approaches the joining member 81.

The retaining bolt 17 is provided with a communication hole 87*a* penetrating along the centerline, the communication hole 87*a* is joined to a communication hole 87*b* on the side of the retaining nut 18 so as to form a communication hole 87 that communicates with the first pneumatic chamber 21 and the second pneumatic chamber 22.

As described above, the first pneumatic chamber 21 is provided with the first inlet/outlet 5 and is formed on the one end side (input side) of the second pneumatic chamber 22, and the cylinder device 1 has the communication hole (communication hole 87) that communicates with the first pneumatic chamber 21 and the second pneumatic chamber 22.

The hydraulic pressure generating unit 55 is disposed on the output side of the joining member 81.

The hydraulic pressure generating unit 55 is a hydraulic pressure generating assembly that includes the piston housing 14 having a substantially circular cylinder shape and generates the hydraulic pressure by driving the second pneumatic chamber 22, the second hydraulic chamber 32, and the first hydraulic chamber 31 which are formed in the housing.

The piston housing 14 is a member having a substantially circular cylinder shape with an inner shape in which the second pneumatic chamber 22, the second hydraulic chamber 32, and the first hydraulic chamber 31 are formed from the input side.

At the center of the piston housing 14, the thin portion 15 that slides in the cylinder 2 with a predetermined clearance from the inner circumferential surface of the cylinder 2 is formed on an outer circumferential portion. Opposing end portions of the thin portion 15 are formed to have an outer diameter smaller than that of the thin portion 15.

The retaining nut 18 that blocks an opening of the piston housing 14 is screwed and fixed to the end portion of the piston housing 14 on the input side, by fitting a male screw formed on the retaining nut 18 in female threads formed on the piston housing 14.

The retaining nut 18 is provided with a recessed portion on the output side, and the second pneumatic chamber 22 is formed by a space formed by the recessed portion and the end surface of the second piston 12 disposed on the output side of the retaining nut 18 in the piston housing 14.

In addition, an O-ring (not illustrated) seals a space between the side surface of the retaining nut 18 and the inner circumferential surface of the cylinder 2, and the transfer pneumatic chamber 85 is formed by a space surrounded by the end surface of the retaining nut 18 on the input side, the inner circumferential surface of the cylinder 2, and the end surface of the first piston 11 on the output side.

When the air is supplied from the second inlet/outlet 6 to the transfer pneumatic chamber 85 via the transfer inlet/outlet channel 86, the hydraulic pressure generating unit 55 and the joining member 81 are separated from each other, and the hydraulic pressure generating unit 55 is transferred to the output side in the cylinder 2.

As described above, the transfer pneumatic chamber 85 is formed between the first pneumatic chamber 21 and the second pneumatic chamber 22 and separates the second pneumatic chamber 22 from the first pneumatic chamber 21 so as to transfer the second pneumatic chamber 22 along with the first hydraulic chamber 31 and the second hydraulic chamber 32 to the other end side (output side).

At the center of the recessed portion formed in the retaining nut 18, there is provided with a through-hole in which the rod portion 50*b* is slidably inserted, and the end surface of the rod portion 50*b* on the input side projects more than the end surface of the retaining nut 18 on the input side.

The rod portion 50*b* penetrates through the second pneumatic chamber 22, the second piston 12 to be described below, a protruding portion 57, the second hydraulic chamber 32, and a lid 34 along the centerline thereof.

The rod portion 50*b* functions as a pushing rod that presses the first hydraulic chamber 31 and abuts on the rod portion 50*a* due to the pressure of the first pneumatic chamber 21 such that the rod portion 50 is formed during the joining of the joining member 81 and the retaining nut 18.

As described above, the first hydraulic chamber 31 is formed on the other end side of the second hydraulic chamber 32, and the first piston 11 (the first piston 11 and the rod portion 50) is formed up to the first hydraulic chamber 31 by penetrating through the second pneumatic chamber 22 and the second hydraulic chamber 32.

In addition, the communication hole (communication hole 87) and the piston rod (rod portion 50) of the first piston 11 are configured to be separable into the rod portion 50*a* and the rod portion 50*b* between the first pneumatic chamber 21 and the second pneumatic chamber 22.

Further, the bottom surface of the retaining nut 18 is provided with the communication hole 87*b* at the position corresponding to the retaining bolt 17, and the communication hole 87*b* communicates with the communication hole 87*a* and forms the communication hole 87 when the joining member 81 joins to the retaining nut 18.

A check valve 88 is formed on the end portion of the communication hole 87*b* on the input side. The check valve 88 is a valve mechanism that is opened and circulates air when the communication hole 87*b* is joined to the communication hole 87*a*, and is blocked and restricts the circulation of the air when the communication holes are not joined to each other.

As illustrated in FIG. 1C, the check valve 88 has a circular cylindrical shape and is configured to accommodate a spherical body (valve body) 83 and a coil spring 84 (represented by an arrow line such that the figure is not complicated) inside a circular cylindrical member 82 in which a valve seat with a front end portion having a smaller diameter is formed.

The coil spring 84 biases the spherical body 83 to the side of an opening of the circular cylindrical member 82, and the outer diameter of the spherical body 83 is larger than the inner diameter of the front end opening of the circular cylindrical member 82. Therefore, the spherical body engages with the opening and blocks the opening.

The check valve 88 has a configuration in which the circular cylindrical member 82 does not slip out. In other words, a groove having an elliptical shape is formed on the outer circumferential surface of the circular cylindrical member 82 in the thrust direction, and a pin is fitted into the groove in the radial direction (not illustrated). In this manner, even when the circular cylindrical member 82 is pushed by the coil spring 84 so as to move to the input side, the groove is caught on the pin so as not to slip out when the circular cylindrical member moves to some extent.

On the other hand, a protrusion 89 is formed on the front end of the through-hole of the retaining bolt 17 and has the outer diameter smaller than the inner diameter of the opening of the circular cylindrical member 82, and the protrusion 89 pushes the spherical body 83 into the inside of the circular cylindrical member 82 such that the opening is opened and the communication hole 87*a* and the communication hole 87*b* are connected to each other when the communication hole 87*a* is joined to the communication hole 87*b*.

As described above, the check valve 88 is provided in order to prevent the fixing of the hydraulic pressure generating unit 55 by actuating the second hydraulic chamber 32 before the air of the transfer pneumatic chamber 85 flows into the second pneumatic chamber 22 and the output rod 7 abuts on the workpiece 100, in a case where the communication hole 87*b* is separated from the communication hole 87*a*.

As described above, the communication hole (communication hole 87) is formed to penetrate through the first piston 11, the first pneumatic chamber 21 transfers the first piston to the side of the second pneumatic chamber 22 that separates the first piston 11, and the separated communication holes (the communication holes 87*a* and 87*b*) and the separated piston rods (rod portions 50*a* and 50*b*) are joined to each other.

Back to FIG. 1A, in order to form the second hydraulic chamber 32, the protruding portion 57 protruding from the inner circumferential surface of the cylinder 2 in the centerline direction is formed on the output side of the second piston 12.

A coil spring 33 is disposed between the end surface of the second piston 12 on the output side and the end surface of the protruding portion 57 on the input side and biases the second piston 12 in a separating direction from the protruding portion 57, and the rod portion 50*b* of the first piston 11 and a rod portion 58 of the second piston 12 are inserted into the center of the coil spring 33.

With such a configuration described above, in the initial state, the end surface of the second piston 12 on the input side abuts on the front end of an edge of the recessed portion of the retaining nut 18, and a gap 52 for securing a stroke by which the second piston 12 is pushed to the side of the protruding portion 57 is formed between the end surface of the second piston 12 on the output side and the end surface of the protruding portion 57 on the input side.

In addition, a portion of the piston housing 14, in which the gap 52 is formed, is provided with a through-hole 40 through which the air in the gap 52 escapes to a space between the piston housing 14 and the cylinder 2 when the second piston 12 moves to the side of the protruding portion 57.

The protruding portion 57 has, on the centerline, a through-hole reaching the second hydraulic chamber 32 and the rod portion 58 of the second piston 12 is slidably inserted into the through-hole.

Further, the rod portion 58 has, on the centerline, a through-hole penetrating through the second piston 12 and the rod portion 50 of the first piston 11 is slidably inserted into the through-hole.

As described above, the rod portion 58 is formed to have a circular cylindrical shape, and an end portion of the rod portion, which penetrates through the protruding portion 57 and is exposed to the second hydraulic chamber 32 has a function of a piston that pressurizes oil in the second hydraulic chamber 32.

Here, when P1 represents pressure of the air in the first pneumatic chamber 21 and the second pneumatic chamber 22, S1 represents a sectional area of the second piston 12 in the second pneumatic chamber 22 (an area obtained by projecting a portion receiving the pressure from air, in the thrust direction, the same in the following description), S2 represents a sectional area of the rod portion 58 in the second hydraulic chamber 32, and F1 represents a force by which the coil spring 33 biases the second piston 12, hydraulic pressure P2 of the second hydraulic chamber 32 is obtained in a relationship of $P2=(P1 \cdot S1-F1)/S2$. Therefore, when an expression of $(P1 \cdot S1-F1)/S2>P1$ is satisfied, the pressure of the second pneumatic chamber 22 is amplified and transmitted to the second hydraulic chamber 32.

The hydraulic pressure generating unit 55 is configured to satisfy such a condition and, as will be described below, the second hydraulic chamber 32 firmly fixes the hydraulic pressure generating unit 55 with the amplified hydraulic pressure.

The second hydraulic chamber 32 is configured to have a space, with the input side thereof partitioned by the protruding portion 57, the outer circumferential portion thereof partitioned by the thin portion 15 of the piston housing 14, and the output side thereof partitioned by the lid 34, and is filled with hydraulic oil.

When the second piston 12 is pressed to the side of the protruding portion 57 by the force in the thrust direction, the rod portion 58 is inserted into the second hydraulic chamber 32, and thus the second hydraulic chamber 32 is pressurized in accordance with the expression described above. In particular, when the output rod 7 abuts on the workpiece 100 (more specifically, a tool attached on the front end of the output rod 7 abuts on the workpiece 100), rapid pressurizing is performed.

When the second piston 12 is pressed to the side of the protruding portion 57 by the force in the thrust direction, the rod portion 58 is inserted into the second hydraulic chamber 32, and thus the second hydraulic chamber 32 is pressurized in accordance with the expression described above. At this time, the pressurized pressure uniformly presses the surrounding inner walls. A sectional area of an inner wall of the second hydraulic chamber 32 in the thrust direction is smaller on the input side than on the output side by a sectional area of the rod portion 58, when the sectional areas on the input side and the output side are compared to each other. Therefore, since the force of the oil inside the second hydraulic chamber 32, which presses the inner wall, is larger on the output side on which the sectional area is larger, a force that causes the second hydraulic chamber 32 to move to the output side is applied to the second hydraulic chamber 32. Hence, a force is applied to the hydraulic pressure generating unit 55 in a direction in which the second hydraulic chamber 32 presses the output rod 7; however, since the output rod 7 cannot move, the hydraulic pressure generating unit 55 also stops at the position.

As described above, the hydraulic pressure increased inside the second hydraulic chamber 32 cannot move in the thrust direction because the output rod 7 stops. Thus, pressure is applied to the thin portion 15 having weak stiffness, the thin portion is elastically deformed and expands in the radial direction (outward direction from the centerline) represented by arrow lines, and the outer circumferential surface of the thin portion 15 is pressed to the inner circumferential surface of the cylinder 2. In this manner, the frictional force is generated between the thin portion 15 and the cylinder 2, and the hydraulic pressure generating unit 55 is fixed in the cylinder 2 in the thrust direction.

As described above, the cylinder device 1 includes the fixing means the fixes the second hydraulic chamber 32 and the first hydraulic chamber 31 by generating the force in the radial direction due to the hydraulic pressure of the second hydraulic chamber 32.

More specifically, the fixing means fixes the second hydraulic chamber 32 and the first hydraulic chamber 31 by pressing, to the inner wall of the cylinder 2, a side wall of the second hydraulic chamber 32, which is elastically deformed due to the force in the radial direction.

In addition, the hydraulic chamber (hydraulic chamber 30) generates the hydraulic pressure by receiving the force in the direction to the other end side, which is applied to the hydraulic chamber through pressurization by the pressurizing pneumatic chamber (pneumatic chamber 20), and a force in a direction to the one end side, which is applied to the hydraulic chamber by the output rod 7.

The pressurizing pneumatic chamber (pneumatic chamber 20) is configured to include the first pneumatic chamber 21 having the first piston 11 that pressurizes the first hydraulic chamber 31, the second pneumatic chamber 22 having the second piston 12 that pressurizes the second hydraulic chamber 32.

The outer circumferential surface of the lid 34 is provided with the male screw and is fixed by screwing the male screw in the female threads formed on the end portion of the piston housing 14 on the output side.

The lid 34 has, at the center, a through-hole provided with a counterbore portion on the output side, and the front end portion of the rod portion 50 of the first piston 11 is inserted into the through-hole.

A retaining bolt 35 is fixed by being screwed in a screw hole formed in the front end portion of the first piston 11.

The head portion of the retaining bolt 35 abuts on the corresponding counterbore portion formed in the through-hole of the lid 34, and thereby the rod portion 50 is prevented from slipping out.

A third piston 13 provided with the output rod 7 on the output side along the centerline is disposed on the output side of the lid 34, and the first hydraulic chamber 31 is formed by being partitioned by a space formed by the end surface of the lid 34 on the output side, the end surface of the third piston 13 on the input side, the end surface of an oil filler plug 38 on the input side to be described below, and the inner circumferential surface of the piston housing 14.

The center of the end surface of the third piston 13 on the input side is provided with a recessed portion for escaping a case where the rod portion 58 is excessively inserted.

The output rod 7 has a circular cylinder structure including a through-hole on the centerline thereof up to the end portion of the third piston 13 on the input side.

On the input side of the through-hole, the oil filler plug 38 for sealing the first hydraulic chamber 31 after oil supply is fixed by a screw mechanism.

With the configuration, when the first piston 11 approaches the piston housing 14 after the joining member 81 and the retaining nut 18 are joined to each other, the rod portion **50*b* is inserted into the first hydraulic chamber 31 such that the oil in the first hydraulic chamber 31 is pressurized, and the output rod 7** receives the pressurized hydraulic pressure and moves to the output side.

Here, P1 represents pressure of the air in the first pneumatic chamber 21 and the second pneumatic chamber 22, S3 represents a sectional area of the first piston 11 in the first pneumatic chamber 21, P3 represents the hydraulic pressure of the first hydraulic chamber 31, and S4 represents a sectional area of the first piston 11 in the first hydraulic chamber 31.

In this case, a relationship of $P3=S3 \cdot P1/S4$ is satisfied. When an expression of $S3>S4$ is satisfied, the pressure of the first pneumatic chamber 21 is amplified and transmitted to the first hydraulic chamber 31.

As described below, a coil spring 36 performs bias to the input side. However, when F2 represents a force due to the bias, and S5 represents a sectional area of the third piston 13 in the first hydraulic chamber 31, a force F3 with which the output rod 7 presses the workpiece 100 is obtained in an expression of $F3=(P1 \cdot S3 \cdot S5/S4)-F2$.

The hydraulic system of the cylinder device 1 is set such that the pressure of the first pneumatic chamber 21 is amplified in the first hydraulic chamber 31 and a force F3 necessary for working of the workpiece 100 is exerted by the output rod 7 (the thrust is increased).

As described above, the hydraulic chamber 30 (pneumatic chamber 20) is configured to include the first hydraulic chamber 31 (first pneumatic chamber 21) in which the output rod 7 is provided and the second hydraulic chamber 32 (second pneumatic chamber 22) in which fixing means is provided. The hydraulic pressure amplifying means amplifies the hydraulic pressure generated in the first hydraulic chamber 31 and outputs the amplified hydraulic pressure to the output rod 7.

An opened end of the piston housing 14 on the output side is provided with a screw groove, and a retaining nut 37 provided with a through-hole at the center, into which the output rod 7 is inserted, is screwed to screw groove.

The coil spring 36 is disposed between the end surface of the third piston 13 on the output side and the end surface of the retaining nut 37 on the input side and biases the third piston 13 and the retaining nut 37 in a separating direction from each other, and the output rod 7 is inserted into the center of the coil spring 36.

As described above, the first hydraulic chamber 31 includes an output piston (the third piston 13) that presses the output rod 7 in an output direction, and the cylinder device 1 includes bias means that biases the output piston in a direction opposite to the output direction.

The coil spring 36 has a function of preventing a position of the output rod 7, which abuts on the workpiece, from being shifted with the output rod 7 moving, before the second hydraulic chamber 32 is pressurized such that the hydraulic pressure generating unit 55 is clamped in the cylinder 2 when the pneumatic chambers 20 (the first pneumatic chamber 21 and the second pneumatic chamber 22) are pressurized.

The coil spring 36 has a function of biasing the third piston 13 and the output rod 7 to the input side (a direction of the lid 34) inside the hydraulic pressure generating unit 55 and a function of preventing motion of the output rod 7 to the output side from occurring due to an external force (for example, disturbance) other than the pressurizing of the pneumatic chamber 20 and the pressurizing of the first hydraulic chamber 31. At this time, the coil spring 36 may cause the third piston 13 (output rod 7) to abut on a part of the lid 34 or the hydraulic pressure generating unit 55 or may cause the third piston to be separated from the lid or the hydraulic pressure generating unit by the oil inside the first hydraulic chamber 31 as illustrated in FIG. 1A.

In addition, the coil spring 36 has a function of supporting the motion in a case where the third piston 13 and the output rod 7 retreat to an original position after the output rod 7 performs forward motion due to the pressurizing of the pneumatic chamber 20 and the pressurizing of the first hydraulic chamber 31.

A configuration without the coil spring 36 may be employed. However, the configuration can be employed in a condition that the end surface of the third piston 13 on the output side does not abut on the end surface of the hydraulic pressure generating unit 55 on the input side at all. This state means a state in which the output rod 7 has a very short movement distance and has little motion or a state in which the movement distance is very long and it is not possible to design/manufacture the optimal coil spring.

The lid 4 is a circular cylindrical member and is provided with a recessed portion on the input side thereof, into which the cylinder 2 is inserted.

The inner circumferential surface of the recessed portion is provided with female threads and a male screw formed on a corresponding outer circumferential surface of the cylinder 2 is fitted in the female threads. In this manner, the lid and the cylinder are screwed to each other.

The lid 4 has, on the centerline, a through-hole for insertion of the output rod 7, and the output rod 7 extends to the outside of the lid 4 through the through-hole.

Similar to the projecting portion 44 of the lid 3, a projecting portion 45 provided with a groove on the front end thereof is formed on the bottom surface of the recessed portion of the lid 4. When the piston housing 14 (the hydraulic pressure generating unit 55) moves in the output direction, the retaining nut 37 abuts on the projecting portion 45 of the lid 4. The groove on the front end of the projecting portion 45 is formed such that air supplied from the second inlet/outlet 6 in an abutting state is rapidly spread all across the end surface of the third piston 13 by passing between the retaining nut 37 and the output rod 7.

Further, a side surface of the lid 4 is provided with an inlet/outlet channel that communicates with the inside of the cylinder 2 from the third inlet/outlet 8, and a third pneumatic chamber 41, which performs intake or exhaust from the third inlet/outlet 8, is formed on the output side in the cylinder 2.

The first inlet/outlet 5 and the second inlet/outlet 6 are opened and depressurized, and thereby the third pneumatic chamber 41 causes the hydraulic pressure generating unit 55 to move to the input side and is used to cause the cylinder device 1 to return to the initial state, by supplying and pressurizing the air from the third inlet/outlet 8.

As described above, the cylinder device 1 includes the third pneumatic chamber 41 that is provided on the other end side in the cylinder 2, has the third inlet/outlet 8, and presses the hydraulic chamber (hydraulic chamber 30) to the one end side.

FIGS. 2A to 4F are views for illustrating actuation of the cylinder device 1.

Figure 2A:
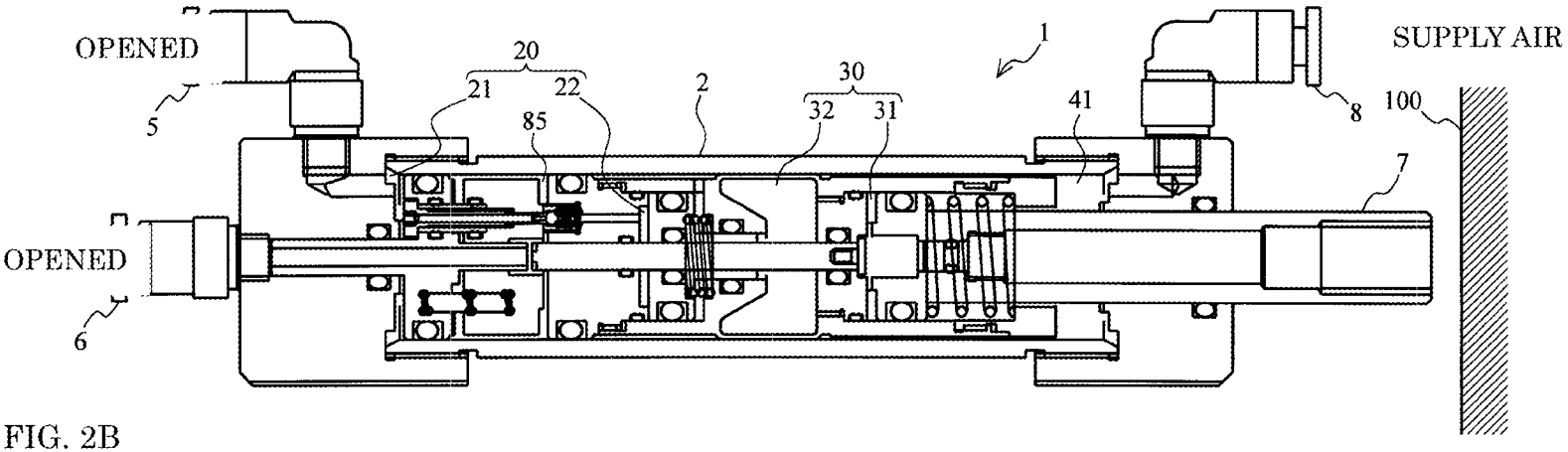
FIGS. 2A and 2B are views for illustrating actuation of a cylinder device of the first embodiment.

First, as illustrated in FIG. 2A, while the first inlet/outlet 5 and the second inlet/outlet 6 are opened and the pneumatic chambers 20 (the first pneumatic chamber 21 and the second pneumatic chamber 22) and the transfer pneumatic chamber 85 are depressurized, air is supplied from the third inlet/outlet 8 such that the third pneumatic chamber 41 is pressurized, thereby setting the pneumatic chambers 20, the transfer pneumatic chamber 85, and the hydraulic chambers 30 (first hydraulic chamber 31 and the second hydraulic chamber 32) to the initial state.

Figure 2B:
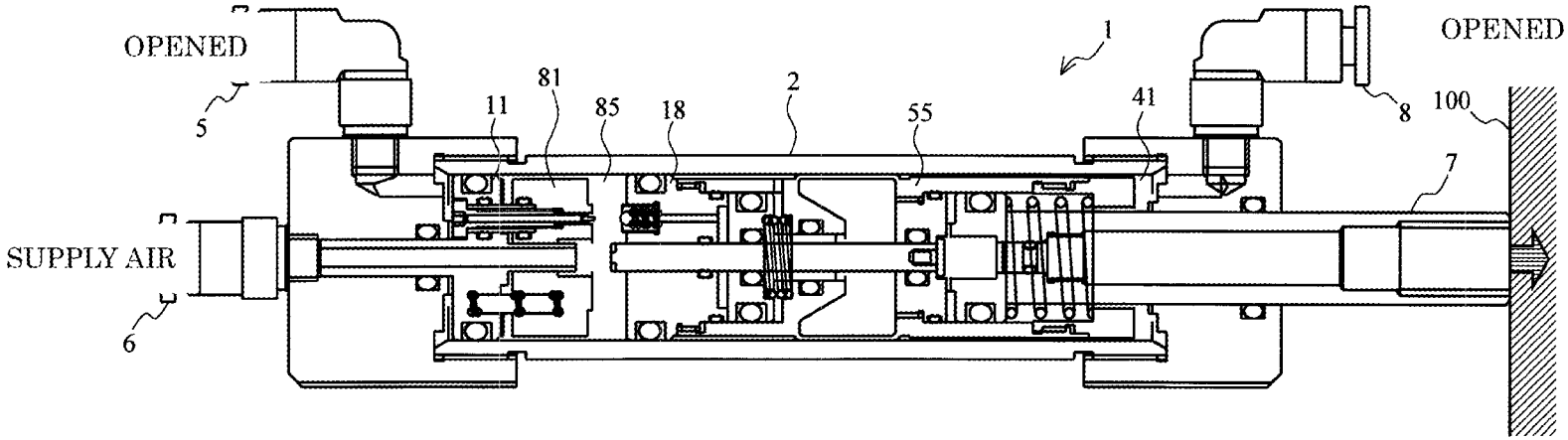

Next, as illustrated in FIG. 2B, while the third inlet/outlet 8 is opened and the third pneumatic chamber 41 is depressurized, the opening of the first inlet/outlet 5 is maintained, the air is supplied from the second inlet/outlet 6, and thus the transfer pneumatic chamber 85 is pressurized.

At that time, a part of the supplied air is emitted from the first inlet/outlet 5 through the communication hole 87*a*; however, a larger amount of air is supplied. Therefore, the pressure of the transfer pneumatic chamber 85 is increased and the retaining nut 18 presses the hydraulic pressure generating unit 55. In this manner, the hydraulic pressure generating unit 55 slides and moves to the output side until the output rod 7 abuts on the workpiece 100.

The abutting causes the output rod 7 to apply the force in the output direction to the workpiece 100. In the figures, the magnitude of the force is indicated by a size of an arrow line.

A portion constituted by the first piston 11 and the joining member 81 and the hydraulic pressure generating unit 55 are separated from each other and the hydraulic pressure generating unit 55 is transferred to the output side, and thereby the output rod 7 achieves a long stroke.

Figure 3C:
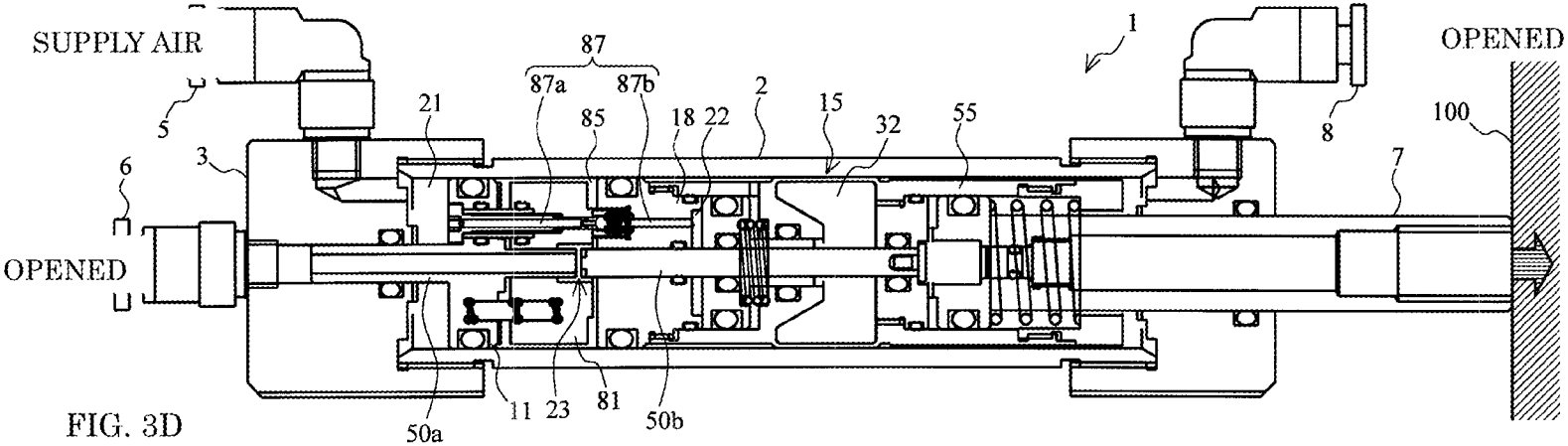
FIGS. 3C and 3D are views for illustrating actuation of the cylinder device of the first embodiment.

Next, as illustrated in FIG. 3C, when the hydraulic pressure generating unit 55 moves and the front end of the output rod 7 (more specifically, the front end of the tool attached to the output rod 7, omitted in the figure) abuts on the workpiece 100, the second inlet/outlet 6 is opened and the transfer pneumatic chamber 85 is depressurized, and the air is supplied from the first inlet/outlet 5 and the first pneumatic chamber 21 is pressurized.

A part of the supplied air leaks to the transfer pneumatic chamber 85 and is discharged from the second inlet/outlet 6; however, an amount of air flowing from the first inlet/outlet 5 is larger than an amount of air that passes through the communication hole 87*a* (air is strongly injected from the first inlet/outlet 5). Therefore, the pressure of the first pneumatic chamber 21 is increased and the first piston 11 and the joining member 81 move in the output direction.

In addition, the rod portion 50*a* is pulled out from the through-hole of the lid 3 and elongates and contracts in the cylinder 2, depending on the movement of the joining member 81.

As described above, the end surface of the joining member 81 on the output side abuts on the end surface of the retaining nut 18 on the input side, and the constituent members of the first piston 11 and the joining member 81 and the hydraulic pressure generating unit 55 are joined to each other.

During the joining, the communication hole 87*a* and the communication hole 87*b* are connected and the communication hole 87 is formed.

The rod portion 50*a* also moves to the output side along with the first piston 11; however, a gap 23 is to be formed between the end surface of the rod portion 50*a* on the output side and the end surface of the rod portion 50*b* on the input side, when the joining member 81 and the retaining nut 18 are joined to each other.

Since the gap 23 is formed, first, the hydraulic pressure is first generated in the second hydraulic chamber 32, the thin portion 15 expands and abuts on the cylinder 2, and the hydraulic pressure generating unit 55 is fixed to the second pneumatic chamber 22.

In a process in which the hydraulic pressure generating unit 55 is fixed, since the sectional area on the output side is larger than the sectional area on the input side by the sectional area of the rod portion 58, of the sectional area of the inner wall of the second hydraulic chamber 32 in the thrust direction, and thus the pressing force is generated by a difference between the sectional areas in the direction of the output rod 7 and the output rod 7 abuts on the workpiece and stops. Therefore, the hydraulic pressure generating unit 55 stops moving. In this manner, since the oil inside the second hydraulic chamber 32 cannot move in the thrust direction, the internal pressure is further increased, and the thin portion 15 is pressed and elastically deformed in the radial direction, thereby abutting the thin portion 15 on the inner circumferential surface of the cylinder 2. In this manner, the hydraulic pressure generating unit 55 is fixed in the cylinder 2.

Figure 3D:
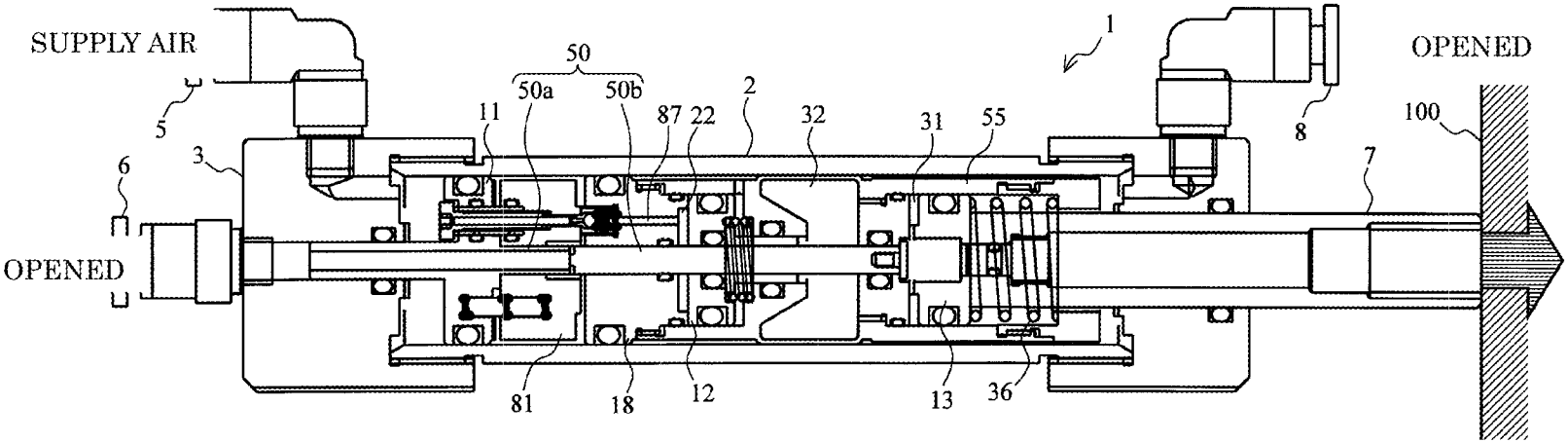

Next, as illustrated in FIG. 3D, with the second inlet/outlet 6 and the third inlet/outlet 8 maintaining the opened state after the joining member 81 and the retaining nut 18 are joined, the air is further supplied from the first inlet/outlet 5.

The first piston 11 further moves to the output side, the end surface of the rod portion 50*a* on the output side abuts on the end surface of the rod portion 50*b* on the input side, and both of the rod portions are joined to each other and the rod portion 50 is formed.

In this manner, the first piston 11 presses the first hydraulic chamber 31 via the rod portion 50, the oil is pressurized, and the hydraulic pressure is increased.

The hydraulic pressure generating unit 55 is fixed due to the hydraulic pressure of the second hydraulic chamber 32, and the hydraulic pressure generating unit 55 is firmly held in the thrust direction by the grip force by the thin portion 15. Motion is not performed even when the force in the thrust direction, in which the hydraulic pressure of the first hydraulic chamber 31 is generated, is received. Therefore, the hydraulic pressure increased in the first hydraulic chamber 31 is applied in a direction in which the third piston 13 is pressed, and the output rod 7 presses the workpiece 100 with large force as represented by an arrow line, against the bias force of the coil spring 36.

At this time, in a case where the output rod 7 abuts on the workpiece 100, and then there is no movement, deformation, or the like due to the hydraulic pressure applied from the output rod 7 only by pressing or fixing the workpiece 100 at the position, the third piston 13 does not move in the thrust direction inside the first hydraulic chamber 31, and thus the oil in the first hydraulic chamber 31 is not taken out to the outside along with movement of the O-ring.

In addition, the second hydraulic chamber 32 is sealed to contain the oil inside and has a constant volume. Therefore, when the thin portion 15 expands in the radial direction, a volume in the thrust direction is reduced and shortened by an increase in volume in the radial direction, and the second piston 12 can move forward by the shortened amount of the volume. The thin portion 15 has a very small amount of deformation in the radial direction and has a small amount of deformation in the thrust direction depending on the deformation in the radial direction, and thus the second piston also has a small distance of movement and little moves. Therefore, the oil in the second hydraulic chamber 12 is not taken out to the outside by moving the O-ring. In the normal design, the movement distance of the second piston 12 is set to a distance within a range of the elastic deformation of a seal member such as the O-ring. In this case, the O-ring does not move at all, and thus the internal oil is not taken out to the outside.

Here, the generation of hydraulic pressure on a cylinder end, that is, a case where the hydraulic pressure is generated in a state in which the hydraulic pressure generating unit 55 abuts on the cylinder end (lid 4) on the output side before the output rod 7 abuts on the workpiece is described. In this example of the actuation, it is possible to generate hydraulic thrust even when the output rod 7 does not abut on the workpiece 100 in some cases.

Hereinafter, the actuation will be described.

When the hydraulic pressure generating unit 55 moves forward and abuts on the cylinder end (lid 4), and then the joining member 81 moves to the output side and joins to the hydraulic pressure generating unit 55, the second piston presses the second hydraulic chamber 32 by the second pneumatic chamber 22. Since the hydraulic pressure generating unit 55 cannot move forward, the oil inside the second hydraulic chamber 32 is constricted and pressurized by the lid 34 and the second piston 12. The thin portion 15 is elastically deformed and fixes the inner wall of the cylinder 2. When the hydraulic pressure generating unit 55 is fixed to the cylinder 2, the grip force in the thrust direction is increased and the stiffness is increased. Thus, the hydraulic thrust that is generated in the first hydraulic chamber 31 in the thrust direction can be received, and the hydraulic thrust is generated in the output rod 7.

In this manner, even in a state in which the output rod 7 does not abut on the workpiece, it is possible to apply the hydraulic thrust to the output rod 7.

Figure 4E:
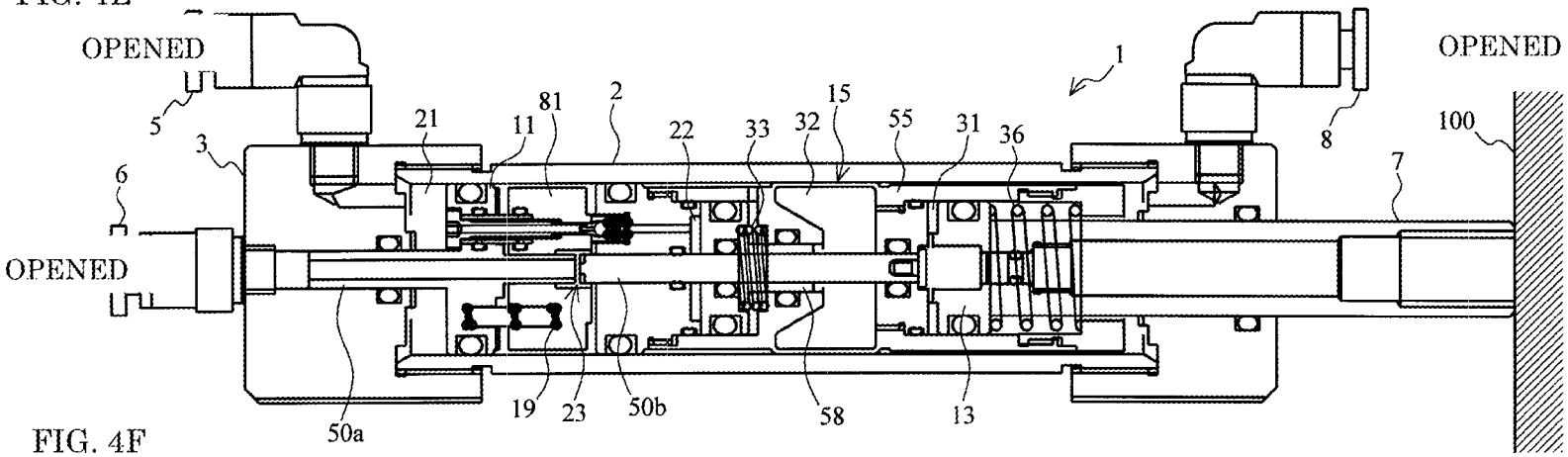
FIGS. 4E and 4F are views for illustrating actuation of the cylinder device of the first embodiment.

As illustrated in FIG. 4E, when the pressing causes working of the workpiece 100 to be ended, the first inlet/outlet 5 is opened, and the first pneumatic chamber 21 and the second pneumatic chamber 22 are depressurized, with the opening states of the second inlet/outlet 6 and the third inlet/outlet 8 maintaining the opened state.

In this manner, the hydraulic pressure of the hydraulic chamber 31 and the hydraulic chamber 32 is reduced.

In the first hydraulic chamber 31, the third piston 13 returns to the input side due to the bias force of the coil spring 36, and the rod portion 50*b* also returns to the input side due to the bias force of the coil spring 33. In this manner, the output rod 7 does not apply the force to the workpiece 100.

In the second hydraulic chamber 32, the rod portion 58 returns to the input side due to the bias force of the coil spring 33, and the elastic deformation of the thin portion 15 is restored due to the restoring force. In this manner, the fixing of the hydraulic pressure generating unit 55 is canceled.

Further, the first piston 11 moves to the input side with respect to the joining member 81 due to the bias force of the coil spring 19, the rod portion 50*a* and the rod portion 50*b* are separated from each other and the gap 23 is formed therebetween.

Figure 4F:
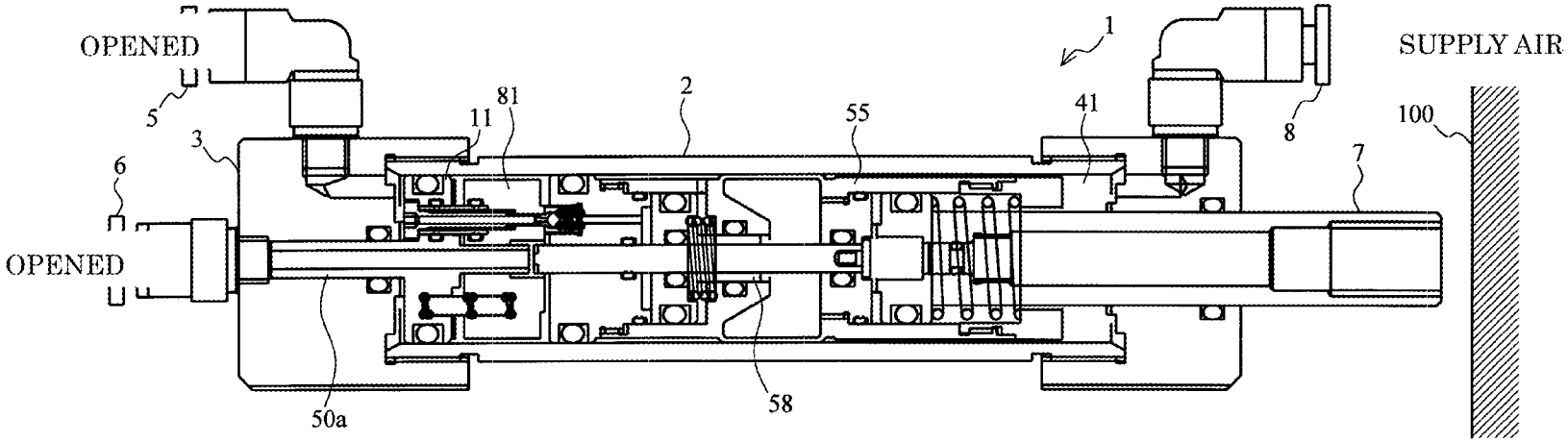

Next, as illustrated in FIG. 4F, with the first inlet/outlet 5 and the second inlet/outlet 6 opened, the air is supplied from the third inlet/outlet 8, and thus the third pneumatic chamber 41 is pressurized.

In this manner, the constituent members from the first piston 11 and the joining member 81 and the hydraulic pressure generating unit 55 are pushed to the input side and move to the end portion of the cylinder 2, and the initial state is restored. At this time, the rod portion 50*a* is accommodated in the through-hole of the lid 3.

Here, an example, in which the workpiece 100 is pressed and clamped by using the cylinder device 1, will be described.

The optimal clamping member is to be attached to the front end of the output rod 7 in order to press and clamp the workpiece 100 in the cylinder device 1.

The cylinder device 1 performs clamping actuation of a member that presses and clamps the workpiece 100 in the following order.

(1) First, the first inlet/outlet 5 and the second inlet/outlet 6 are opened and the air is supplied to the third inlet/outlet 8, and thereby the cylinder device 1 comes into the initial state. In this manner, the clamping member retreats, and the workpiece 100 is mounted at a predetermined position on a mounting stand. At this time, the workpiece 100 is mounted not to move even when being pressed.

(2) Next, the first inlet/outlet 5 and the third inlet/outlet 8 are opened and the air is supplied from the second inlet/outlet 6.

The output rod 7 moves forward in the output direction by the air drive, and the front end of the clamp member abuts on the workpiece 100.

(3) When the front end of the clamp member abuts on the workpiece, the second inlet/outlet 6 and the third inlet/outlet 8 are opened and the air is supplied from the first inlet/outlet 5.

The pressure of the pneumatic chamber 20 is increased, the hydraulic pressure generating unit 55 is fixed to the cylinder 2, and the output rod 7 is driven due to the hydraulic pressure. In this manner, the clamp member strongly presses the workpiece 100 and presses the workpiece 100 with strong force, and thus the workpiece 100 is clamped.

(4) In a case where the workpiece 100 is released from the clamping member, the first inlet/outlet 5 and the second inlet/outlet 6 are opened and the air is supplied from the third inlet/outlet 8. The clamp member retreats by the air drive, and then the workpiece 100 is detached from the predetermined position. As described above, the clamp apparatus includes detachment means.

Hereinafter, while the workpiece 100 is replaced, the cycle described above is repeatedly performed.

Figure 5A:
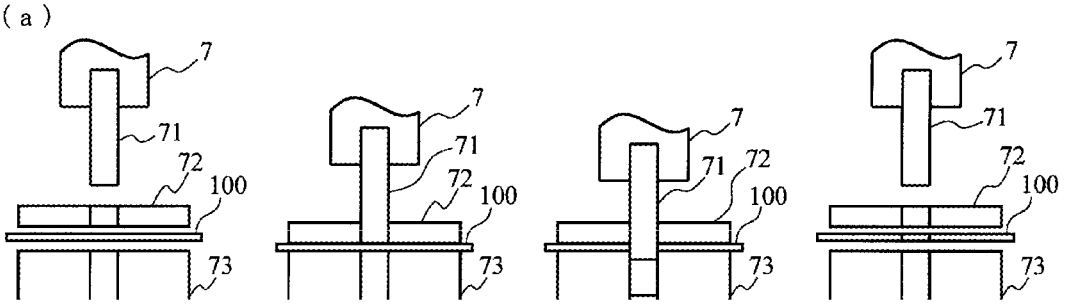
FIGS. 5AA to 5CD are views for illustrating an example of press working.

FIGS. 5AA to 5AD are views for illustrating an example in which press working (punching) is performed by using the cylinder device 1.

The press machine (not illustrated) fixes the cylinder device 1 with the output direction as a downward direction.

A punch 71 that is a tool for a punching die is fixed on the front end of the output rod 7 so as to be coaxial to the output rod 7, and the mounting stand 73, the workpiece 100, and a jig 72 are disposed in this order from below on the lower side thereof. The mounting stand 73, the workpiece 100, and the jig 72 function as workpiece mounting means.

The punch 71 of the embodiment has a circular column shape and is a die that makes a circular hole in the workpiece 100 formed of a metal sheet. However, the circular shape of the punch 71 is an example. Regardless of the shape, it is possible to select any shape corresponding to a shape of the hole drilled in the workpiece 100.

During the punching, the jig 72 is a member that presses the workpiece 100 to the mounting stand 73 and fixes the workpiece 100 and is provided a through-hole through which the punch 71 passes.

The mounting stand 73 is also provided with a through-hole to which the punch 71 escapes during the punching.

In the configuration described above, the cylinder device 1 performs the press working in the following order.

(1) First, the first inlet/outlet 5 and the second inlet/outlet 6 are opened and the air is supplied to the third inlet/outlet 8, and thereby the cylinder device 1 is in the initial state. In this manner, the punch 71 retreats, and the workpiece 100 and the jig 72 are mounted at predetermined positions on the mounting stand 73.

(2) Next, the workpiece 100 is pressed and fixed to the mounting stand 73 by the jig 72. The first inlet/outlet 5 and the third inlet/outlet 8 are opened and the air is supplied from the second inlet/outlet 6.

The output rod 7 moves forward in the output direction by air drive, and the front end of the punch 71 abuts on the workpiece 100.

(3) When the front end of the punch 71 abuts on the workpiece, the second inlet/outlet 6 and the third inlet/outlet 8 are opened and the air is supplied from the first inlet/outlet 5.

The pressure of the pneumatic chamber 20 is increased, the hydraulic pressure generating unit 55 is fixed to the cylinder 2, and the output rod 7 is driven due to the hydraulic pressure. In this manner, the punch 71 is pressed to the workpiece 100 with a strong force, and the workpiece 100 is punched. As described above, the press machine includes press means.

(4) When the hole is formed in the workpiece 100, the first inlet/outlet 5 and the second inlet/outlet 6 are opened and the air is supplied from the third inlet/outlet 8. The punch 71 is pulled up by the air drive, and then the workpiece 100 is detached from the predetermined position. As described above, the press machine includes detachment means.

Figure 5B:
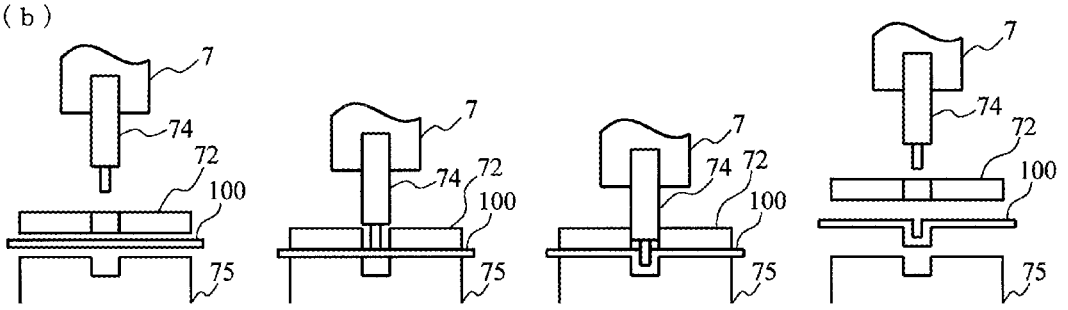

FIGS. 5BA to 5BD are views for illustrating an example in which a recessed portion is formed in the workpiece 100 by the press working by using the cylinder device 1.

A male die 74 as a tool for press working is fixed to the front end of the output rod 7 so as to be coaxial to the output rod 7.

The male die 74 is a male die having a circular column shape, has the front end provided with a protrusion for forming the recessed portion, and is coaxially attached to the output rod 7.

A female die 75 is a female die and has a recessed portion formed to receive the protrusion of the male die 74.

In the configuration described above, the cylinder device 1 performs the press working in the following order.

(1) First, the first inlet/outlet 5 and the second inlet/outlet 6 are opened and the air is supplied to the third inlet/outlet 8, and thereby the cylinder device 1 is in the initial state. In this manner, the male die 74 retreats, and the workpiece 100 and the jig 72 are mounted on the female die 75.

(2) Next, the workpiece 100 is pressed and fixed to the female die 75 by the jig 72. The first inlet/outlet 5 and the third inlet/outlet 8 are opened and the air is supplied from the second inlet/outlet 6.

The output rod 7 moves forward in the output direction by the air drive, and the front end of the male die 74 abuts on the workpiece 100.

(3) When the front end of the male die 74 abuts on the workpiece, the second inlet/outlet 6 and the third inlet/outlet 8 are opened and the air is supplied from the first inlet/outlet 5.

The pressure of the pneumatic chamber 20 is increased, the hydraulic pressure generating unit 55 is fixed to the cylinder 2, and the output rod 7 is driven due to the hydraulic pressure. In this manner, the male die 74 is pressed to the workpiece 100 with a strong force, and the recessed portion is formed in the workpiece 100.

(4) When the recessed portion is formed in the workpiece 100, the first inlet/outlet 5 and the second inlet/outlet 6 are opened and the air is supplied from the third inlet/outlet 8. The male die 74 is pulled up by the air drive. Subsequently, the workpiece 100 is detached from the predetermined position.

Figure 5C:
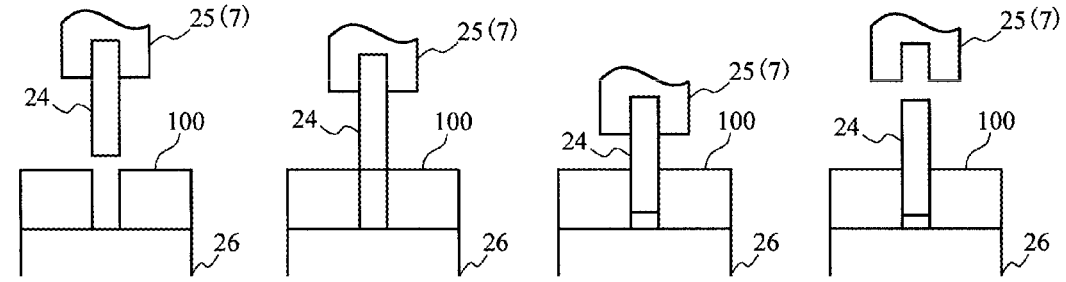

FIGS. 5CA to 5CD are views for illustrating an example in which a pin 24 is press-fitted in the workpiece 100 by the press working by using the cylinder device 1. The press-fitting of the pin 24 needs, particularly, a stroke and thus is appropriately performed by using a cylinder device 1*a* of a second embodiment to be described below.

A pin holder 25, which is a press-fitting tool, is fixed to the front end of the output rod 7 so as to be coaxial to the output rod.

On the output side of the output rod 7, a mounting stand 26 and the workpiece 100 are disposed from below in this order.

The pin holder 25 is attached on the front end of the output rod 7. The pin holder 25 has a function of holding the pin 24 until the pin 24 is press-fitted, and detaching (releasing) the pin after the press-fitting is performed.

In the cylinder device 1, the pins 24 temporarily inserted in the following order of numbers in parentheses are press-fitted.

(1) First, the first inlet/outlet 5 and the second inlet/outlet 6 are opened and the air is supplied to the third inlet/outlet 8, and thereby the cylinder device 1 is in the initial state. In this manner, the pin holder 25 holding the pin 24 retreats upward, and the workpiece 100 is mounted at a predetermined position on the mounting stand 26. The workpiece 100 is provided with holes in which the pins 24 are press-fitted.

(2) The second inlet/outlet 6 is opened and the air is supplied from the first inlet/outlet 5.

The first inlet/outlet 5 and the third inlet/outlet 8 are opened and the air is supplied from the second inlet/outlet 6.

The output rod 7 (not illustrated) and the pin holder 25 move forward in the output direction by the air drive, and the front end of the pin 24 that is held by the pin holder 25 abuts on the workpiece 100.

(3) When the front end of the pin 24 abuts on the workpiece, the second inlet/outlet 6 and the third inlet/outlet 8 are opened and the air is supplied from the first inlet/outlet 5.

The pressure of the pneumatic chamber 20 is increased, the hydraulic pressure generating unit 55 is fixed to the cylinder 2, and the output rod 7 is driven with the hydraulic pressure. In this manner, the pin 24 is press-fitted in the hole of the workpiece 100 with high force.

(4) When the pin 24 is press-fitted in the workpiece 100, the pin 24 is separated from the pin holder 25, the first inlet/outlet 5 and the second inlet/outlet 6 are opened, and the air is supplied from the third inlet/outlet 8. The pin holder 25 is pulled up by the air drive.

Second Embodiment

Figure 6A:
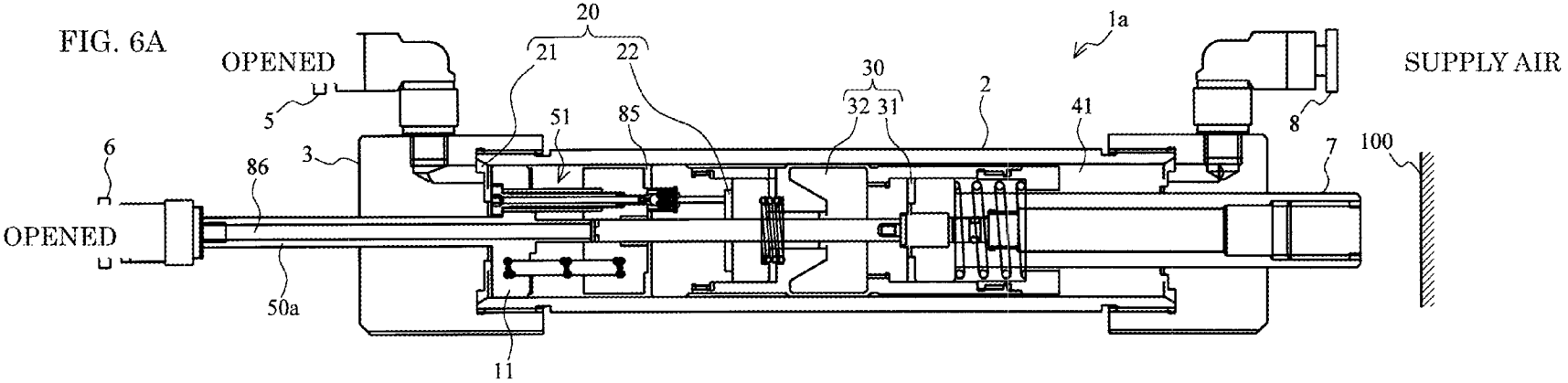
FIGS. 6A and 6B are views for illustrating actuation of a cylinder device of a second embodiment.

FIG. 6A is a sectional view of the cylinder device 1*a* according to the embodiment in a thrust direction, and the cylinder device 1*a* is set in the initial state. In FIG. 6A, an O-ring is omitted for avoiding complicatedness of the figure.

In the cylinder device 1*a*, the rod portion 50*a* penetrates through the through-hole of the lid 3 and slidably extends to the outside of the lid 3, and the second inlet/outlet 6 is attached to the end portion of the rod portion 50*a* on the input side. The other configuration is the same as that of the cylinder device 1.

In the cylinder device 1*a*, since the rod portion 50*a* enters along with the second inlet/outlet 6 from the outside of the lid 3, depending on the movement of the first piston 11, it is possible to further elongate the stroke of the output rod 7.

As described above, in the cylinder device 1*a*, the transfer inlet/outlet channel 86 extends to the outside of the cylinder 2 and elongates and contracts with an extending portion sliding inside and outside the cylinder 2.

FIGS. 6A to 8F are views for illustrating actuation of the cylinder device 1*a*.

FIGS. 6A to 8F correspond to FIGS. 2A to 4F, and thus, repeated description will be omitted and differences are described, hereinafter.

Figure 6B:
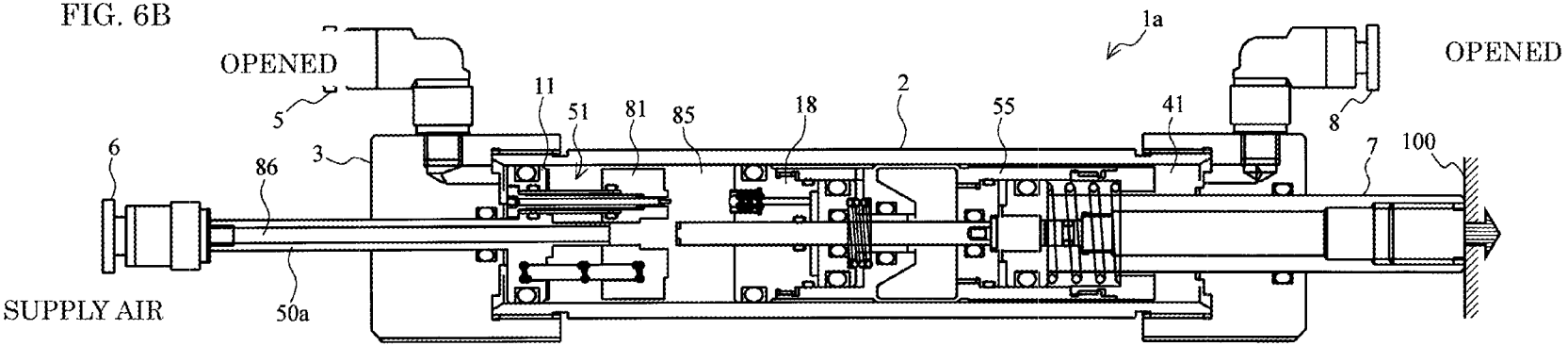

As illustrated in FIGS. 6A and 6B, in the cylinder device 1*a*, the rod portion 50*a* for elongation and contraction is provided to the outside of the lid 3 on the input side.

In addition, in order to increase the stroke of the output rod 7, a length of the gap 51 in the thrust direction is set to be larger than that in the cylinder device 1.

Figure 7C:
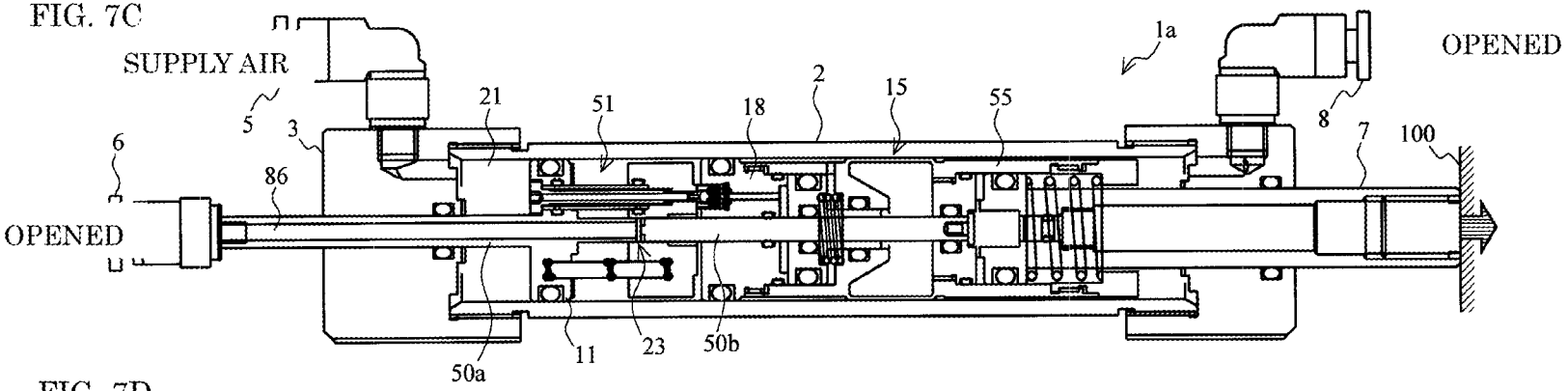
FIGS. 7C and 7D are views for illustrating actuation of the cylinder device of the second embodiment.
Figure 7D:
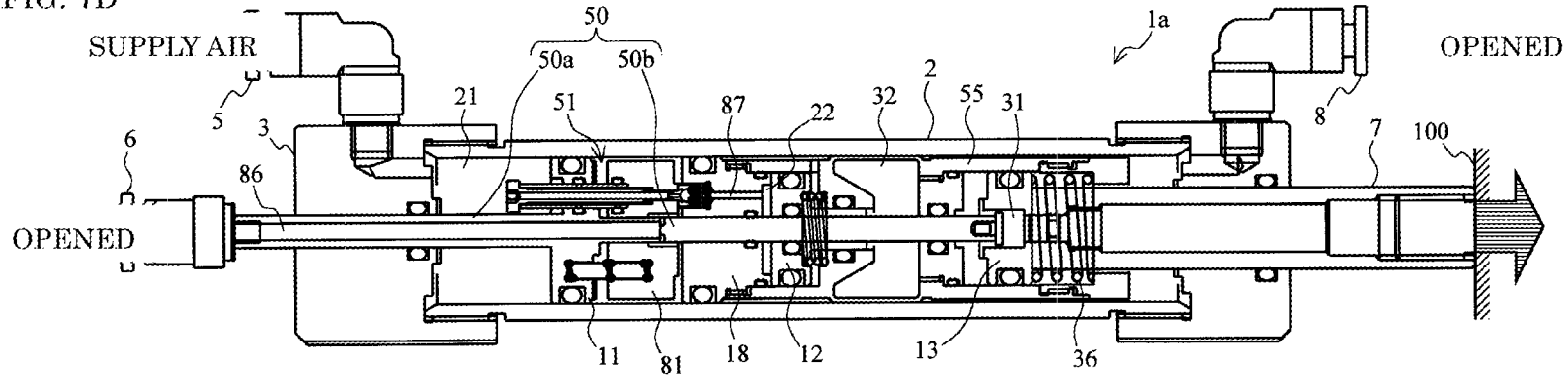

As illustrated in FIGS. 7C and 7D, since the rod portion 50*a* provided outside the lid 3 is pulled into the inside of the cylinder 2, the first pneumatic chamber 21 is significantly expanded, and the stroke of the output rod 7 is increased.

In addition, since the gap 51 is large, the stroke during the generation of the hydraulic pressure is increased, and the workpiece 100 moves in the pressure direction. This actuation is suitable for a case of press-fitting of the pin 24 in FIGS. 5CA to 5CD.

Figure 8E:
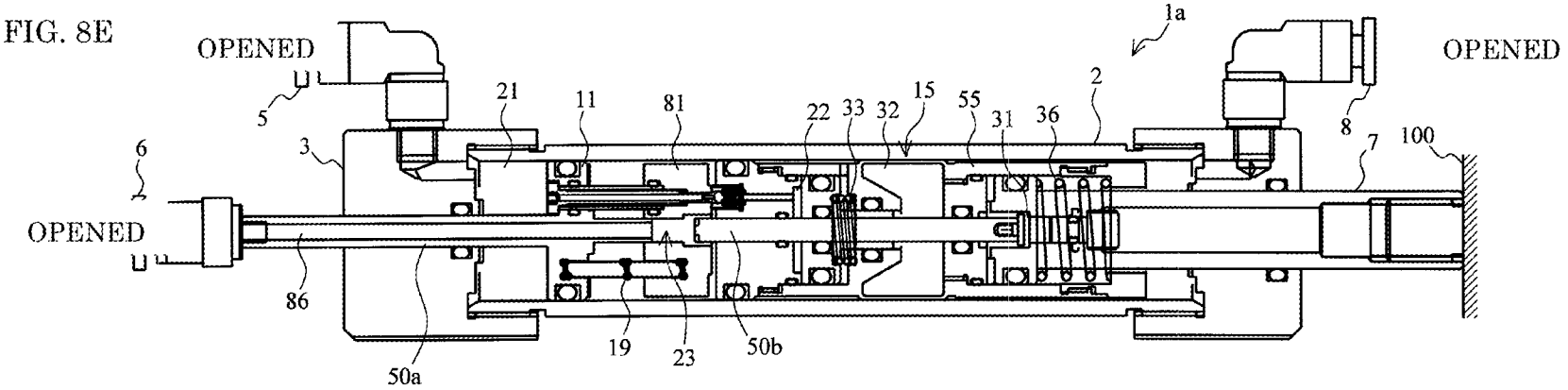
FIGS. 8E and 8F are views for illustrating actuation of the cylinder device of the second embodiment.
Figure 8F:
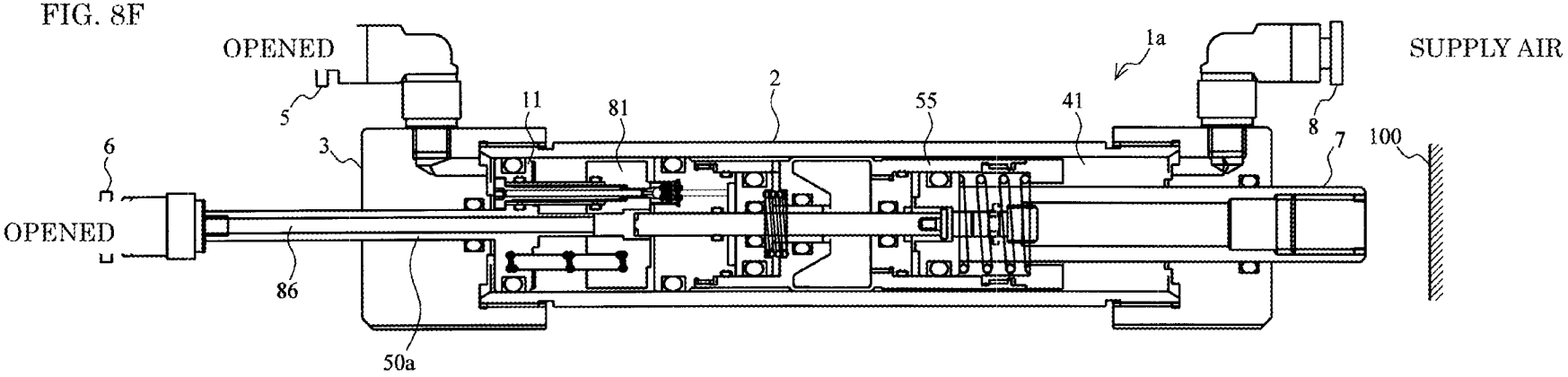

As illustrated in FIGS. 8E and 8F, since the rod portion 50*a* pulled out to the outside of the cylinder 2 during the restoration, the output rod 7 can be separated from the workpiece 100 with a long stroke.

Third Embodiment

In a cylinder device 1*b* according to the embodiment, the hydraulic pressure generating unit 55 is fixed to the cylinder 2 by the clamper.

Figure 9A:
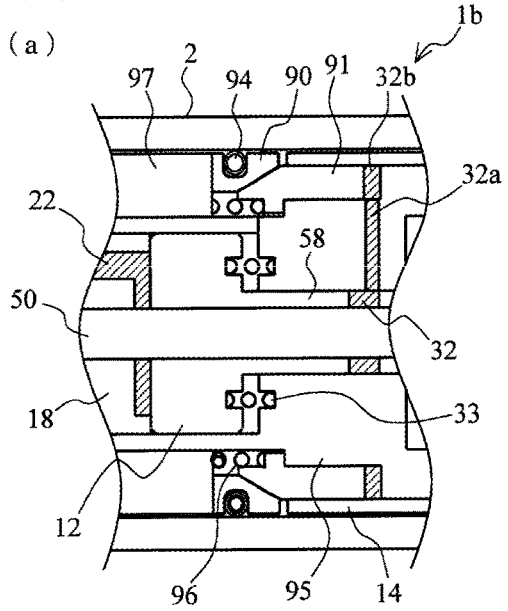
FIGS. 9A to 9D are views for illustrating a cylinder device of a third embodiment.

FIG. 9A illustrates a sectional view of the cylinder device 1*b* in the thrust direction.

In FIG. 9A, the entire figure is not provided but the vicinity of the second pneumatic chamber 22 and the second hydraulic chamber 32 are cut out and illustrated.

The end surface of the second hydraulic chamber 32 on the input side is configured to have an end surface of a circular column member 95 fixed to the piston housing 14 and an end surface of an annular member 91 provided around the circular column member 95.

The annular member 91 has an inner circumferential surface being in contact with an outer circumferential surface of the circular column member 95 and an outer circumferential surface being in contact with an inner circumferential surface of the piston housing 14. Such a contact surface is sealed by an O-ring, and the annular member 91 having airtightness as it is can move in the thrust direction.

Female threads are placed on the input side of the circular column member 95 and a member corresponding to the retaining nut 18 in the first embodiment is attached to the female threads. A male screw is formed on the input side of the member corresponding to the retaining nut 18, and a nut 97 is screwed and fixed thereto.

A coil spring 96 is disposed between the end surface of the nut 97 on the output side and the annular member 91. While the annular member 91 secures a space that configures the second hydraulic chamber 32 (although not illustrated, restriction means for restricting movement of the annular member 91 to the output side is provided in order to secure the space), and the coil spring 96 causes the bias on the output side.

Therefore, the annular member 91 moves to the input side when the hydraulic pressure of the second hydraulic chamber 32 is increased, and the annular member 91 moves to the output side and returns to the original position when the hydraulic pressure is reduced.

Figure 9B:
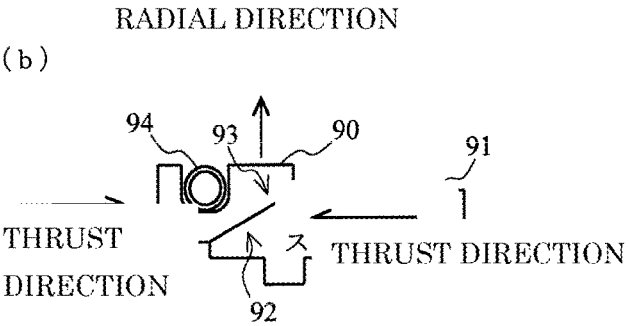

As illustrated in FIG. 9B, a taper portion 92 is formed on the end portion of the annular member 91 on the input side, and an outer diameter of the taper portion is reduced as a portion approaches the input side (left side in the Figure).

A clamper 90 is disposed in a space formed between the taper portion 92 and the end surface of the nut 97 on the output side of the annular member 91.

The clamper 90 is an annular member in which a taper portion 93, of which an inner diameter is reduced as a portion approaches the input side, is formed and an angle of the taper portion 93 is equal to an angle of the taper portion 92.

Figure 9C:
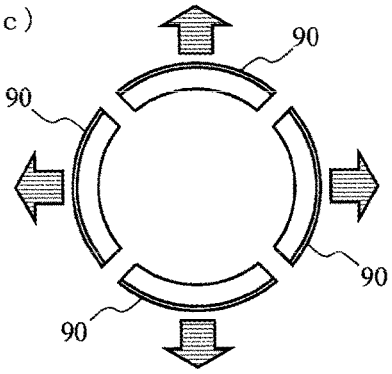
Figure 9D:
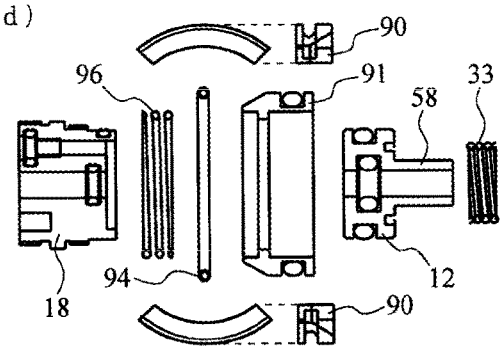

The clamper 90 illustrated in FIG. 9C is divided into four parts so as to be widened in the radial direction represented by arrow lines.

An outer circumferential surface of the clamper 90 is formed to be parallel to the inner circumferential surface of the cylinder 2, and a predetermined clearance is formed between the outer circumferential surface of the clamper 90 and the inner circumferential surface of the cylinder 2 in the initial state such that the frictional force is not generated between the two surfaces.

Further, the outer circumferential surface of the clamper 90 is provided with a groove in a circumferential direction, and the O-ring 94 is disposed in the groove.

In general, the O-ring is disposed to maintain the airtightness; however, the O-ring 94 is disposed to cause the clamper 90 widened in the radial direction to return to the original state.

Therefore, the height of the groove formed in the outer circumferential surface of the clamper 90 is set to a size larger than the diameter of the O-ring 94, and thus the O-ring 94 is provided not to be in contact with the inner circumferential surface of the cylinder 2.

In the embodiment, the O-ring 94 is used; however, in a case where the clamper is widened in the radial direction and the inner diameter is increased, any member may be used as long as the member contracts the widened size to the original inner diameter and causes the clamper to return to the original state. For example, a ring-shaped elastic member having a string shape with elasticity may be used. In addition, a member having an annular shape by joining both ends of the coil spring may be used.

In the cylinder device 1*b* configured as described above, in the initial state, the pressure of the second hydraulic chamber 32 is low, and thus the coil spring 96 biases the annular member 91 to the output side. In this manner, a sufficient clearance is secured between the end surface of the nut 97 on the output side and the taper portion 92 of the annular member 91.

Therefore, the clamper 90 is bundled up by contractile force of the O-ring 94 in the central axis direction, and thus a clearance is formed between the clamper 90 and the inner circumferential surface of the cylinder 2 such that the hydraulic pressure generating unit 55 is movable in the thrust direction.

On the other hand, when the pressure of the second hydraulic chamber 32 is increased, the clamper 90 is pushed and moves in the direction to the input side due to the hydraulic pressure.

The clamper 90 is sandwiched between the end surface of the nut 97 on the output side and the taper portion 92 of the annular member 91 and receives a force in the thrust direction from both end sides as illustrated by an arrow line in FIG. 9B.

To be specifically described, when the second piston 12 moves forward, the pressure of the second hydraulic chamber 32 is increased, and the increase in pressure reaches a hydraulic chamber 32*b* (second hydraulic chamber) of a space of the end surface of the annular member 91 through a communication channel 32*a*.

The annular member 91 moves to the input side while the clamper 90 is widened, when a force, with which the O-ring 94 contracts the clamper 90, is smaller than a force that is generated due to the pressure of the second hydraulic chamber 32 and causes movement in the thrust direction. At this time, the oil inside the second hydraulic chamber 32, which is pushed by the second piston 12, flows into the space of the end surface through the communication channel 32*a* and thus the annular member 91 moves in the thrust direction.

The force in the thrust direction is converted into a force in the radial direction as illustrated by an arrow line in FIG. 9B, by abutting of the taper portion 92 of the annular member 91 and the taper portion 93 of the clamper 90. As a result, the clamper 90 is pushed in the radial direction.

In this manner, the outer circumferential surface of the clamper 90 abuts on the inner circumferential surface of the cylinder 2, the frictional force is generated therebetween, and the hydraulic pressure generating unit 55 is fixed in the cylinder 2.

A fixing method by the clamper 90 used in the third embodiment can be used in the first embodiment, the second embodiment, and a fourth embodiment to be described below.

In this example, the force in the radial direction is generated by pressing, to the clamper 90, the taper member (annular member 91) moving in the thrust direction, due to the hydraulic pressure generated in the second hydraulic chamber 32, and the second hydraulic chamber 32 and the first hydraulic chamber 31 are fixed by pressing the clamper 90 to the inner wall of the cylinder by the force.

According to the embodiments described above, it is possible to obtain the following effects.

(1) By skillfully combining an air piston and a hydraulic piston and internally providing an air hydraulic mechanism, the piston can be actuated as the air piston until the piston abuts on the workpiece 100 and can be actuated as the hydraulic cylinder after the piston abuts on the workpiece 100, and thus it is possible to realize outputs of both of the movement of the long stroke by the air piston and the large thrust as the characteristic of the hydraulic piston, with only air supply for which there is no need to provide individual ancillary equipment such as a hydraulic pump or hydraulic piping or the like requiring labor for construction.

(2) After the stroke required by the air piston is obtained, the force in the thrust direction is converted into the force in the radial direction by the elastic deformation of the thin portion 15, pushing of the clamper 90, or the like, such that it is possible to fix the hydraulic piston in the cylinder 2.

(3) The force in the radial direction is increased due to the hydraulic pressure such that it is possible to fix the hydraulic piston, and thus the hydraulic piston can be firmly fixed.

(4) It is possible to generate a large force by generating the hydraulic pressure in the hydraulic cylinder fixed in the cylinder 2.

(5) Since the necessary stroke is almost obtained by the air piston and the requisite minimum stroke is obtained by the hydraulic piston, it is possible to decrease a length of the stroke of the hydraulic piston, and thus it is possible to minimize wear due to oil leakage.

In particular, in a case of a using method in which the output rod 7 abuts on the workpiece 100, and only the hydraulic pressure is applied to the workpiece without movement of the output rod 7 after the abutting, the movement distances of the hydraulic pistons in the hydraulic chambers are all within the range of the elastic deformation of the seal member, and thus it is possible not to cause leakage of oil inside the hydraulic chamber.

Next, the fourth embodiment will be described.

In the first to third embodiments described above, the integrally formed piston housing 14 accommodates the second hydraulic chamber 32, which contributes to fixing actuation of fixing (clamping) the piston housing 14 to the cylinder 2, and the first hydraulic chamber 31, which contributes to thrust generating actuation of generating the thrust due to the hydraulic pressure amplifying with the front end of the output rod 7 by the air hydraulic mechanism.

By comparison, in the fourth embodiment, an input-side housing (a second housing 62) provided with the second hydraulic chamber 32 and output-side housings (a first housing 61 and a third housing 63) provided with the first hydraulic chamber 31 are configured to be separated from each other in an independently movable manner. In this manner, the fixing actuation and the thrust generating actuation can be separately performed.

In addition, between the input-side housing and the output-side housings, a moving pneumatic chamber 66 that separates both from each other and the third inlet/outlet 8 that causes the output-side housing to move to the output side by supplying air to the moving pneumatic chamber 66. The input-side housing moves in the output direction by supplying the air from the first inlet/outlet 5 to the second pneumatic chamber 22.

In the fourth embodiment, the moving pneumatic chamber 66 is disposed between the first hydraulic chamber 31 and the second hydraulic chamber 32 so as to function as a transfer pneumatic chamber that transfers the first hydraulic chamber 31 from the one end side to the other end side (output side).

The second housing 62 functions as the input-side housing, and the first housing 61 and the third housing 63 function as the output-side housing.

Figure 10A:
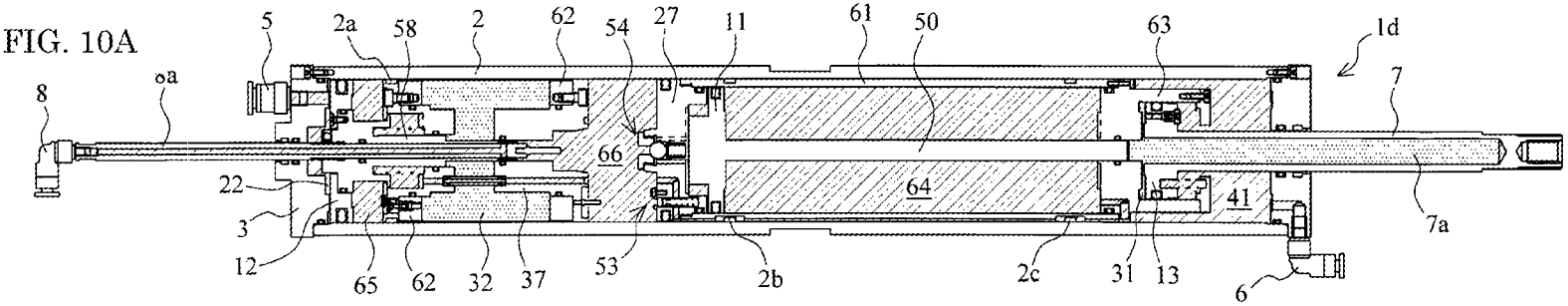
FIGS. 10A and 10B are views for illustrating a cylinder device of a fourth embodiment.
Figure 10B:
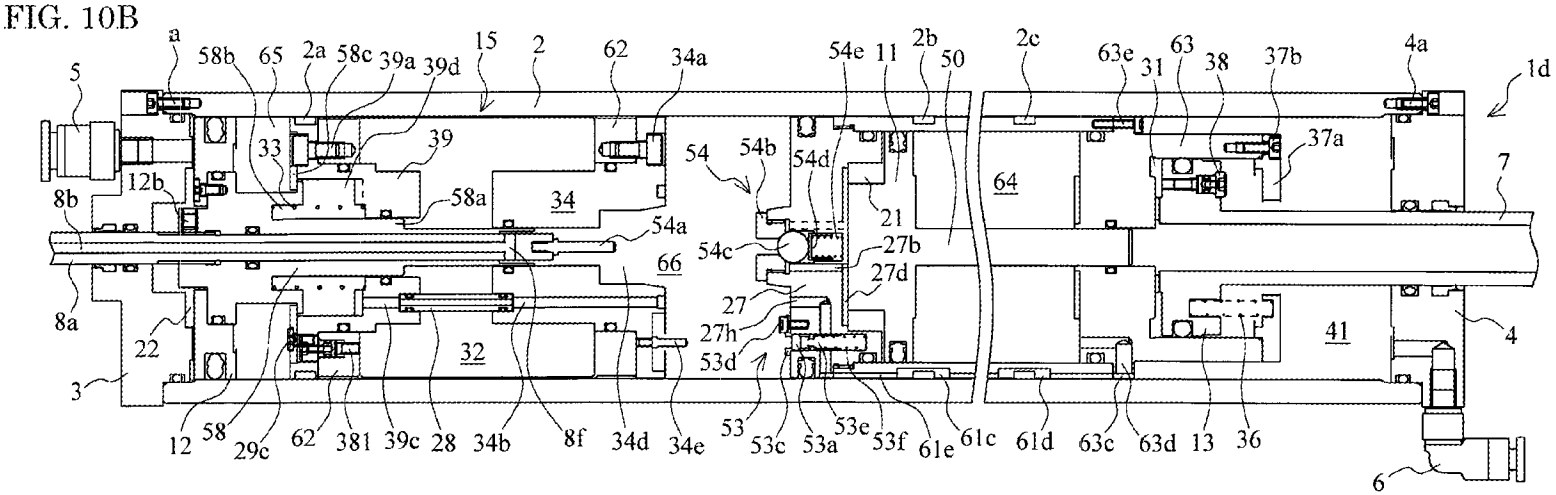

FIGS. 10A and 10B illustrate longitudinal sections in the thrust direction which show a configuration of a cylinder device 1*d* in the fourth embodiment, FIG. 10A illustrates the entire device, and FIG. 10B illustrates an enlarged view of a part thereof.

Figures 11A, 11B, 11C:
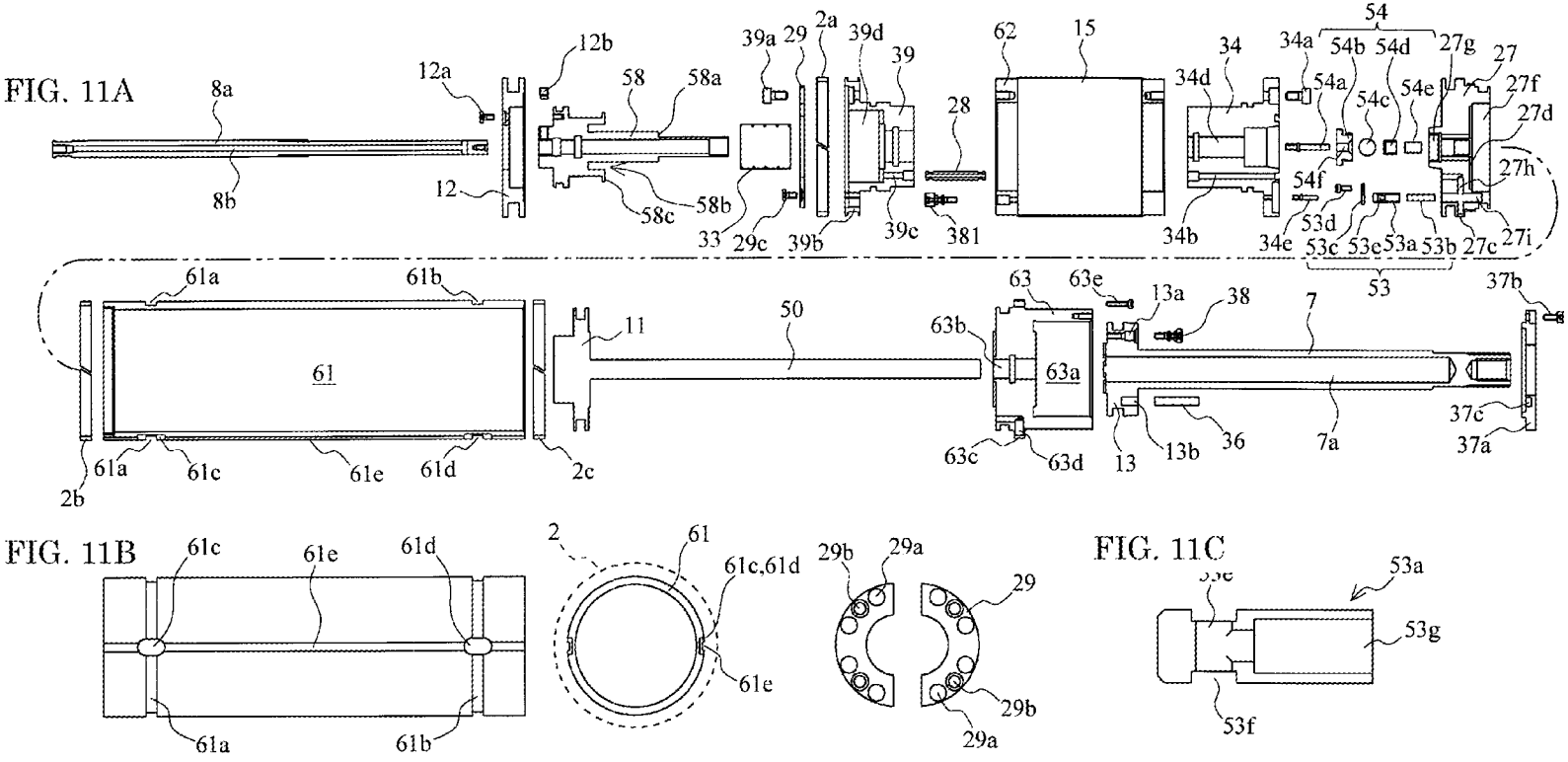
FIGS. 11A to 11C are views of parts of the fourth embodiment.

FIGS. 11A to 11C illustrate parts disposed in the cylinder 2, FIG. 11A illustrates a longitudinal section of the parts, FIG. 11B illustrate a front view and a side of the first housing 61 and a front view of a retaining ring 29, and FIG. 11C is an enlarged sectional view of a circular cylindrical portion 53*a*.

The same reference signs are assigned to portions having the same structures or the same functions as those in the first embodiment, and the description thereof is appropriately omitted. In addition, in FIG. 7D, O-rings for sealing portions are illustrated; however, the description thereof is omitted. In addition, in order to make the figure easy to be viewed, similarly to the other embodiments, no distinct mark is applied to the sections, only in FIG. 10A, hatched lines are applied to a region in which the air is present, and dots are applied to a region in which the oil is present.

As illustrated in FIGS. 10A to 11C, in the cylinder device 1*d* of the embodiment, instead of the piston housing 14 (refer to FIGS. 1A and 1B) in the first embodiment, the piston housing 60 (not illustrated) having the first housing 61, the second housing 62, and the third housing 63 is disposed in the cylinder 2.

As illustrated in FIGS. 10A and 10B, the housings are disposed from the input side in the order of the second housing 62 that accommodates the rod portion 58 connected to the second piston 12, the first housing 61 that accommodates the first piston 11 to which the rod portion 50 is continuously connected, and the third housing 63 that accommodates the third piston 13 to which the output rod 7 is continuously connected.

The second housing 62 is provided with thick portions on both end sides, the thin portion 15 is configured between the thick portions, and the second hydraulic chamber 32 is formed in the inner side of the thin portion 15.

The thick portions of the second housing 62 on both ends are provided with an oil supply hole for filling the second hydraulic chamber 32 with the oil. After the oil is injected, the second housing 62 is sealed by an oil filler plug 381.

A lid 39 is fixed to the end portion of the second housing 62 on the input side, with a plurality of bolts 39*a* arranged on the circumference thereof. The lid 39 corresponds to the protruding portion 57 in the first embodiment.

The lid 39 has a recessed portion 39*d* (refer to FIG. 11A) with a circular cylinder shape formed on the input side of the lid, and the bottom portion of the recessed portion 39*d* has, at the center thereof, a through-hole for the rod portion 58. On the outer side of the through-hole, a communication hole 39*c* that penetrates through the bottom portion of the recessed portion 39*d* is formed. The communication hole 39*c* configures a part of a path through which a fifth pneumatic chamber 65 to be described below communicates with the third pneumatic chamber 41.

The end portion of the lid 39 on the input side is provided with a flange having a clearance from an inner circumferential wall of the cylinder 2, and the circumferential surface of the flange is provided with a sliding assistant ring 2*a*. The sliding assistant ring 2*a* includes other sliding assistant rings 2*b* and 2*c* and is disposed to make smooth sliding between the inner circumferential surface of the cylinder 2 and the second housing 62.

The rod portion 58 is inserted to penetrate through the recessed portion 39*d* of the lid 39 and the through-hole at the center thereof. The second piston 12 is fixed to the rod portion 58 on the input side with a connection screw 12*a* (refer to FIG. 11A).

The rod portion 58 has a diameter that increases gradually from the output side toward the input side, includes a small-diameter portion, a medium-diameter portion, and a large-diameter portion, and is provided with a step 58*a* on the boundary between the small-diameter portion and the medium-diameter portion. The rod portion 58 moves in the lid 39 in the output direction. In this manner, the second hydraulic chamber 32 formed in the second housing 62 is pressurized, the thin portion 15 is elastically deformed in the radial direction due to the hydraulic pressure, and the piston housings 60 (61 to 63) are fixed in the cylinder 2.

The large-diameter portion of the rod portion 58 is provided with a recessed portion 58*b* formed along the outer circumference of the medium-diameter portion. The medium-diameter portion of the rod portion 58 is inserted into the coil spring 33, one end side of the coil spring 33 is disposed in the recessed portion 58*b*, and the other end side thereof abuts on the bottom surface of the recessed portion 39*d* formed in the lid 39.

The end surface of the large-diameter portion of the rod portion 58 on the output side is provided with a flange 58*c* protruding in the radial direction.

Regarding the rod portion 58, in a state in which the small-diameter portion and the medium-diameter portion of the rod portion 58 inserted into the coil spring 33 penetrate through the lid 39, the retaining ring 29 is fixed to the lid 39 from the input side with a bolt 29*c*. An inner diameter of the retaining ring 29 is formed to be smaller than an outer diameter of the flange 58*c* of the rod portion 58, and thus the coil spring 33 biases the rod portion 58 to the input side such that the rod portion 58 does not slip out.

As illustrated in FIG. 11B, the retaining ring 29 is divided into two portions and is provided with a plurality of holes of a through-hole 29*a* through which the bolt 39*a* (for fixing the lid 39) penetrates on the same circumference and a bolt hole 29*b* for fixing the retaining ring 29 to the lid 39 with the bolt 29*c*. In addition, a joint divided into two portions has a gap without achieving close contact even when the joint is attached to the lid 39, and thus a configuration in which the air in the inside of the fifth pneumatic chamber 65 and the air in the inside of the communication hole 39*c* freely move to and from the insides thereof.

In a state in which the retaining ring 29 is fixed, the second piston 12 is fixed to the rod portion 58 with the connection screw 12*a*. As described above, the rod portion 58 and the second piston 12 are divided from each other because the fixing of the lid 39 with the bolt 39*a* and the fixing of the retaining ring 29 with the bolt 29*c* are performed.

The rod portion 58 is provided with a through-hole at the center, and an inlet/outlet rod 8*a* is inserted into the through-hole. The inlet/outlet rod 8*a* is screwed to the end portion of the rod portion 58 on the input side. Further, the end portion of the rod portion 58 on the input side projects to the input side more than the end surface of the second piston 12, and the inlet/outlet rod 8*a* is fixed in the projecting region with a fixing screw 12*b* in the radial direction.

The lid 3 of the embodiment is provided with a through-hole at the center, and the inlet/outlet rod 8*a* is inserted into the through-hole.

The third inlet/outlet 8 is connected to the inlet/outlet rod 8*a* on the input side.

The inlet/outlet rod 8*a* is provided with an inlet/outlet channel 8*b* in an axial direction, which is connected to the third inlet/outlet 8, and a communication channel 8*f* in the radial direction, which is continuous to the end portion of the inlet/outlet channel 8*b* on the output side.

As described above, the rod portion 58 is provided with the through-hole into which the inlet/outlet rod 8*a* is inserted; however, the through-hole is formed to have a diameter that is larger than the outer diameter of the rod portion 58 from the front end of the rod portion 58 to the front side of the communication channel 8*f*, and thereby a gap is formed therebetween. In this manner, the air supplied from the third inlet/outlet 8 is supplied from the inlet/outlet channel 8*b* through the communication channel 8*f* and further through the gap between the outer circumference of the inlet/outlet rod 8*a* and the inner circumferential surface of the rod portion 58 to the moving pneumatic chamber 66 (to be described below).

The front end of the inlet/outlet rod 8*a* is provided with a recessed portion formed along the central axis thereof, and an opening/closing rod 54*a* of a check valve 54 is press-fitted in the recessed portion.

The inlet/outlet rod 8*a* supplies the air (gas) from the third inlet/outlet 8 to the moving pneumatic chamber 66 to be described below and causes the first housing 61 and the third housing 63 to move in the output direction.

In addition, the inlet/outlet rod 8*a* supplies the air from the third inlet/outlet 8 to the first pneumatic chamber 21, actuates the air hydraulic mechanism, and outputs the thrust from the front end of the output rod 7 in a state in which the second housing 62 and the first housing 61 abut on each other such that the check valve 54 to be described below is opened.

The end surface of the second piston 12 on the input side forms, with the lid 3 and the inner circumferential surface of the cylinder 2, the second pneumatic chamber 22, and the end surface of the second piston 12 on the output side forms, with the lid 39 and the cylinder 2, the fifth pneumatic chamber 65.

A part of the lid 34 is opposite to the lid 39 so as to be inserted into the end portion of the second housing 62 on the output side. The lid 34 is provided with a flange on the output side, the flange abuts on the end portion of the second housing 62 on the output side, and the lid 34 is fixed with a bolt 34*a*.

The lid 34 is provided with a communication hole 34*d* formed to penetrate through the lid at the center thereof. The front end (small-diameter portion) of the rod portion 58 passing through the second hydraulic chamber 32 is inserted to an intermediate portion of the communication hole 34*d*.

The lid 34 is provided with a communication hole 34*b* penetrating through the lid 34, with the communication hole 34*b* formed on the outer side of the communication hole 34*d*. The communication hole 34*b* and the communication hole 39*c* of the lid 39 communicate with each other through a collar 28 having an inner side disposed in the second hydraulic chamber 32.

An opening/closing rod 34*e* projecting from the end surface on the output side is press-fitted into the lid 34. The opening/closing rod 34*e* opens and closes an on-off valve 53 on a communication hole 27*h* that is connected to the communication hole 34*b*.

The first housing 61 is disposed on the output side from the second housing 62.

The end portion of the first housing 61 on the input side is provided with a female screw formed on the inner circumferential surface thereof, the female screw is screwed to a male screw formed on a lid 27, and thereby the lid 27 is fixed to the first housing 61 on the input side.

Between the second housing 62 and the first pneumatic chamber 21, and between the lid 34 and the lid 27 opposite to each other, the moving pneumatic chamber 66 is formed. The air from the third inlet/outlet 8 is supplied to the moving pneumatic chamber 66 through the inlet/outlet channel 8*b*, the communication channel 8*f*, and the communication hole 34*d*, and thereby the moving pneumatic chamber 66 is pressurized to increase in volume. In this manner, the first housing 61 and the third housing 63 move to the output side.

The lid 27 is provided with a recessed portion 27*f* (refer to FIG. 11A) on the output side. The recessed portion 27*f* functions as the end surface of the first pneumatic chamber 21 on the input side.

The lid 27 is provided with a communication hole 27*b* that penetrates through the bottom surface of the recessed portion 27*f* and communicates with the communication hole 34*d* of the lid 34, and the bottom surface of the recessed portion 27*f* is provided with a communication groove 27*d* in the radial direction which is connected to the communication hole 27*b*.

In addition, the lid 27 is provided with the communication hole 27*h* having an L-shaped section, which extends in the radial direction from a position connected to the communication hole 34*b* of the lid 34 and is bent from an intermediate portion to the outer side in the axial direction. The end portion of the communication hole 27*h* in the radial direction is connected to a communication groove 61*e* of the first housing 61 to be described below.

The lid 27 is provided with a recessed portion 27*i* (refer to FIG. 11A) passing over the communication hole 27*h*, and the on-off valve 53 is disposed in the recessed portion 27*i*. The on-off valve 53 includes the circular cylindrical portion 53*a* that is inserted into the recessed portion 27*i* and a coil spring 53*b* that is disposed between the bottom portion in the circular cylindrical portion 53*a* and the bottom portion of the recessed portion 27*i* so as to bias the circular cylindrical portion 53*a* to the input side. The circular cylindrical portion 53*a* that is biased by the coil spring 53*b* is stopped by the fixing ring 53*c*, and the fixing ring 53*c* is fixed to the lid 27 with a bolt 53*d*.

The fixing ring 53*c* has, at the center thereof, a through-hole having a larger diameter than the outer diameter of the opening/closing rod 34*e*, into which the opening/closing rod 34*e* for opening and closing the on-off valve 53 is inserted.

FIG. 11C is an enlarged view of a section of the circular cylindrical portion 53*a*.

As illustrated in FIG. 11C, the fixing portion side of the circular cylindrical portion 53*a* is covered with the bottom portion, and the bottom portion is provided with a through-hole 53*e* formed to penetrate through the bottom portion in the radial direction. The through-hole 53*e* penetrates through a cylinder portion 53*g* that accommodates a part of a coil spring 53*b*.

In addition, the outer circumferential surface of the bottom portion of the circular cylindrical portion 53*a* is provided with an outer circumferential groove 53*f* passing through the through-hole 53*e*. The outer circumferential groove 53*f* enables communication of the communication hole 27*h* even in a case where phases of the through-hole 53*e* and the communication hole 27*h* are shifted, and thus the disposition is easily performed.

In a case where the circular cylindrical portion 53*a* is biased by the coil spring 53*b* and abuts on the fixing ring 53*c*, a passage of the communication hole 27*h* by a conductor is blocked.

On the other hand, when the on-off valve 53 is pushed by the opening/closing rod 34*e* in the output direction, the through-hole 53*e* is connected to the communication hole 27*h*. The opening/closing rod 34*e* approaches the on-off valve 53 in association with the movement of the lid 34 in the output direction and abuts on the circular cylindrical portion 53*a* immediately in front of a position at which the lid 34 and the lid 27 abut on each other (in front of a position separated by a projecting length of the opening/closing rod 34*e*). Further, the lid 34 moves, the opening/closing rod 34*e* pushes the circular cylindrical portion 53*a*, and the through-hole 53*e* and the communication hole 27*h* are connected to each other when the lid 34 and the lid 27 abut on each other.

In addition, the check valve 54 is disposed on the input side of the lid 27.

The check valve 54 includes an opening/closing rod 54*a* that is attached to the front end of the inlet/outlet rod 8*a*, a stop ring 54*b*, a spherical body 54*c*, a circular cylindrical member 54*d*, and a coil spring 54*e*.

The lid 27 is provided with a recessed portion 27*g* in which the check valve 54 is accommodated. In a state in which the spherical body 54*c*, the circular cylindrical member 54*d*, and the coil spring 54*e* are accommodated in the recessed portion 27*g*, the stop ring 54*b* is screwed to the lid 27.

The coil spring 54*e* is disposed between the bottom portion of the recessed portion 27*g* and the bottom portion of the circular cylindrical member 54*d* and biases the spherical body 54*c* via the check valve 54 in the input direction, and thereby a vent hole 54*f* formed in the stop ring 54*b* is closed by the spherical body 54*c*.

In a state in which the lid 34 and the lid 27 abut on each other, the on-off valve 53 is pushed by the opening/closing rod 34*e* and is opened and the communication hole 27*h* comes into a communication state. On the other hand, the check valve 54 is still closed. In other words, in a state in which the lid 34 and the lid 27 are in contact with each other, the opening/closing rod 54*a* has a positional relationship of being separated from the spherical body 54*c*. In this state, when the second piston 12 and the rod portion 58 further moves in the output direction, the opening/closing rod 54*a* disposed on the front end of the rod portion 58 comes into contact with the spherical body 54*c*, and then pushes the spherical body 54*c* against the coil spring 54*e*. In this manner, the check valve 54 is opened.

The first piston 11 to which the rod portion 50 extends at the center thereof is disposed in the first housing 61 to which the lid 27 is screwed.

The disposition of the first piston 11 causes the first housing 61 to be partitioned by the first piston 11. Thus, the first pneumatic chamber 21 is formed on the input side and a fourth pneumatic chamber 64 is formed on the output side.

As illustrated in FIGS. 11A to 11C, the first housing 61 is provided with circumferential grooves 61*a* and 61*b* along the entire circumference thereof on both end sides. As described above, the sliding assistant rings 2*b* and 2*c* are fitted in the circumferential groove 61*a*, and thus smooth sliding between the inner circumferential surface of the cylinder 2 and the first housing 61 is performed.

In addition, the first housing 61 is provided with the communication groove 61*e* along the entire length thereof in the axial direction (longitudinal direction).

The end portion of the communication groove 61*e* on the input side is connected to the communication hole 27*h* of the lid 27.

In order not to block the communication groove 61*e* with the sliding assistant rings 2*b* and 2*c* fitted into the circumferential grooves 61*a* and 61*b*, recessed portions 61*c* and 61*d* are formed that have a width wider than the width of the sliding assistant rings 2*b* and 2*c* and are deeper than the thickness of the sliding assistant rings, at a position at which the circumferential grooves 61*a* and 61*b* intersect with the communication groove 61*e*. A passage of the air from the fifth pneumatic chamber 65 is formed between the communication groove 61*e* and the inner circumferential surface of the cylinder 2.

Back to FIGS. 10A and 10B, the third housing 63 is fixed, with a plurality of bolts 63*e*, to the end portion of the first housing 61 on the output side, in which the first piston 11 is disposed on the inner side.

The third housing 63 is provided with a recessed portion 63*a* (refer to FIG. 11A) on the output side. The bottom surface of the recessed portion 63*a* is provided with a through-hole 63*b* at the center, and the rod portion 50 is inserted into the through-hole 63*b*.

The third housing 63 is provided with a flange formed at an intermediate portion thereof in the axial direction, and the flange is provided with a groove 63*c* that has the same phase so as to communicate with the communication groove 61*e* in the thrust direction.

In addition, the flange of the third housing 63 is provided with a communication hole 63*d* having an L-shaped section, which extends in the radial direction from a position, at which the groove 63*c* is connected to the flange, and is bent in the axial direction from an intermediate portion.

The communication hole 63*d* having the L-shaped section penetrates to the end surface of the third housing 63 on the input side and is connected to the fourth pneumatic chamber 64.

On the other hand, the input side of the groove 63*c* is connected to the communication groove 61*e* formed on the outer circumference of the first housing 61, and the output side thereof is connected to the third pneumatic chamber 41.

The third piston 13 including the output rod 7 at the center thereof is disposed in the recessed portion 63*a* of the third housing 63.

The disposition of the third piston 13 causes the recessed portion 63*a* of the third housing 63 to be partitioned, and the first hydraulic chamber 31 is formed on the input side.

The third piston 13 is provided with an oil supply hole for filling the first hydraulic chamber 31 with the oil. After the oil is injected, the oil supply hole is sealed by the oil filler plug 38.

A cavity 7*a* is formed at the center of the first hydraulic chamber 31 and the output rod 7 and does not penetrate in the axial direction. The cavity 7*a* also configures the first hydraulic chamber 31 and the inside of the cavity 7*a* is also filled with the oil.

The inner diameter of the cavity 7*a* is formed to be larger than the diameter of the rod portion 50, and thus the rod portion 50 enters and exits from the cavity.

A retaining ring 37*a* is fixed with a plurality of bolts 37*b* to the end portion of the third housing 63 on the output side. The fixing of the retaining ring 37*a* is performed in a state in which the third piston 13 is disposed in the recessed portion 63*a*, is filled with the oil, and is sealed with the oil filler plug 38.

A recessed portion 13*b* and a recessed portion 37*c* are formed in surfaces of the third piston 13 and the retaining ring 37*a* which are opposite to each other, respectively, and the coil spring 36 that biases the third piston 13 to the input side is disposed in the recessed portions.

The second housing 62 configures, with the lid 39 and the lid 34, an input-side housing, and the first housing 61 and the third housing 63 configure, with the lid 27 and the retaining nut 37, an output-side housing.

The moving pneumatic chamber 66 is formed between the lid 34 and the lid 27, the input-side housing (second housing 62) and output-side housings (the first housing 61 and the third housing 63) are separated from each other in an independently movable manner.

In other words, the input-side housing (second housing 62) moves in the output direction by supplying the air from the first inlet/outlet 5 to the second pneumatic chamber 22. By comparison, the output-side housings (first housing 61 and the third housing 63) move in the output direction by supplying the air from the third inlet/outlet 8 to the moving pneumatic chamber 66.

Next, two types of actuation performed by the cylinder device 1*d* of the fourth embodiment will be described.

First Actuation

FIGS. 12A to 13E illustrate states of the first actuation performed by the cylinder device 1*d*.

In the first actuation, the front end of the output rod 7 abuts on the workpiece 100, and thereby fixing of the piston housings 60 (61, 62, and 63) is performed. Then, the amplified hydraulic pressure is output from the front end of the output rod 7 at any timing.

First, actuation of causing the cylinder device 1*d* to come into the initial state is described.

Figure 12A:
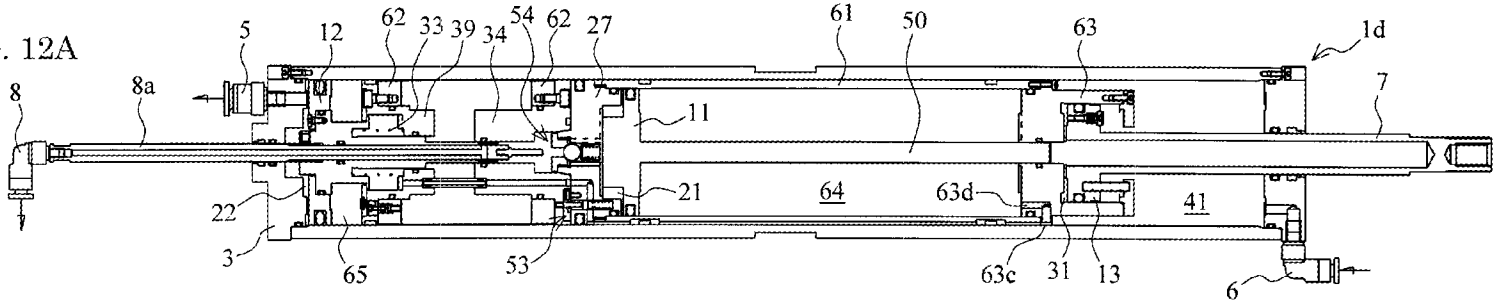
FIGS. 12A and 12B are views for illustrating a state of first actuation of the fourth embodiment.

As illustrated in FIG. 12A, the initial state of the cylinder device 1*d* means a state in which the piston housing 60 and the second piston 12 in the cylinder 2 move to the input side.

Hereinafter, the actuation of causing the device from the states to the initial state is divided and described.

Figure 12B:
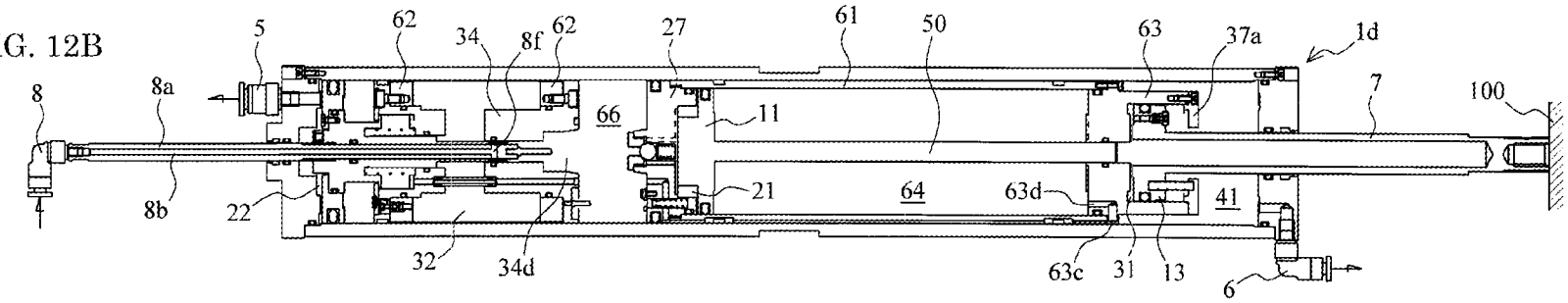

(1) Actuation from a state in FIGS. 10A and 12B, that is, a state in which only the first housing 61 moves, the air is not supplied to the first pneumatic chamber, and the air hydraulic mechanism is not generated.

In this case, the third inlet/outlet 8 is opened and the air is supplied from the second inlet/outlet 6 with predetermined pressure, and thereby the first housing 61 and the third housing 63 move to the input side. Due to this movement, the air in the moving pneumatic chamber 66 is discharged from the third inlet/outlet 8.

The lid 27 and the lid 34 moves until the lids are in close contact with each other, and the lids come into the initial state.

Figures 13C, 13D, 13E:
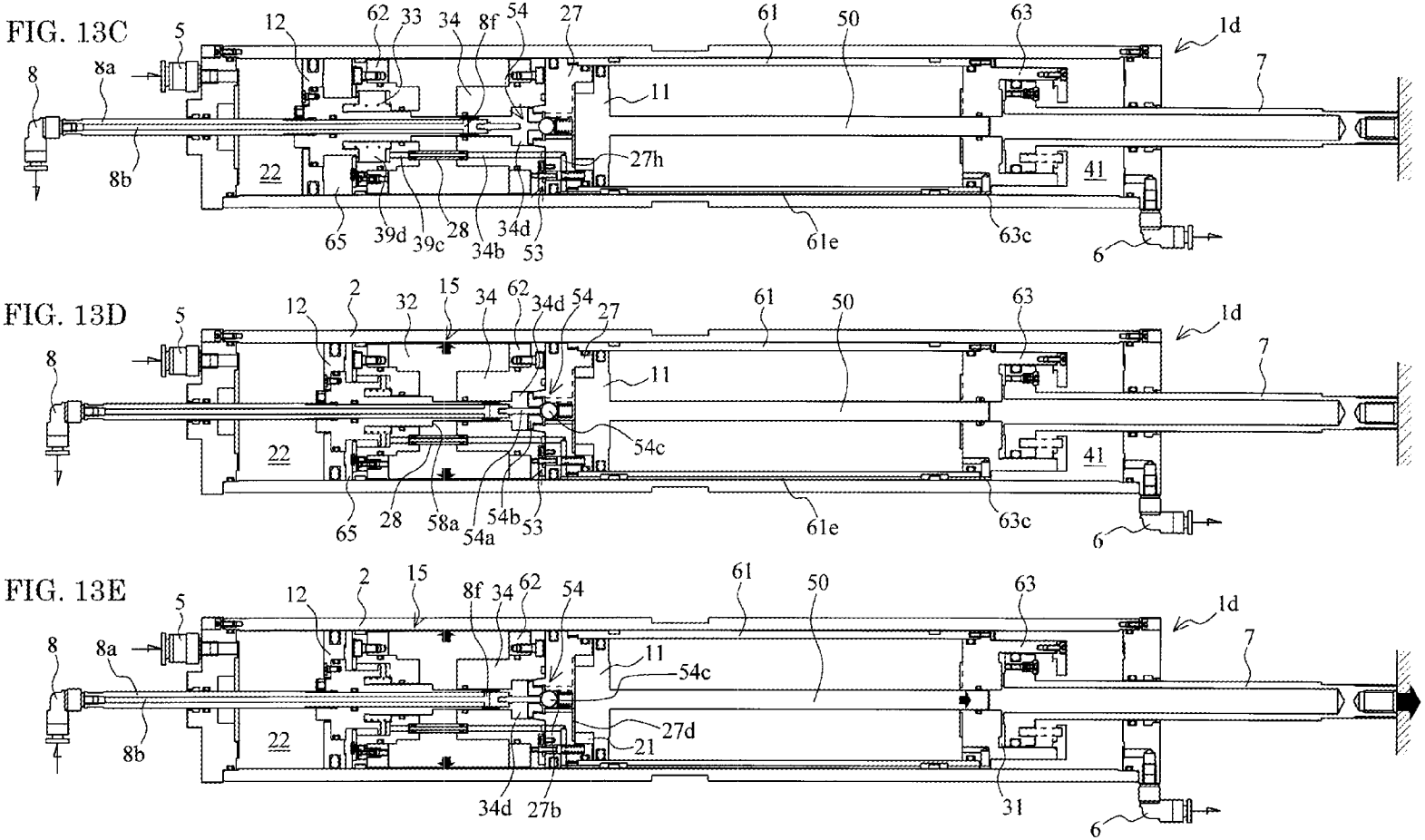
FIGS. 13C to 13E are views for illustrating another state of the first actuation of the fourth embodiment.

(2) Actuation from a state in FIGS. 13C and 13D, that is, a state in which the lid 27 and the lid 34 are in close contact with each other; however, the air is not yet supplied to the first pneumatic chamber 21.

In this state, the first piston 11 comes into the initial state. Therefore, in a case where the entirety returns to the initial state, as will be described below, the third inlet/outlet 8 and the first inlet/outlet 5 are opened and the air is simultaneously supplied from the second inlet/outlet 6, and thereby the entirety may return to the initial state.

Figures 14A, 14B, 14C:
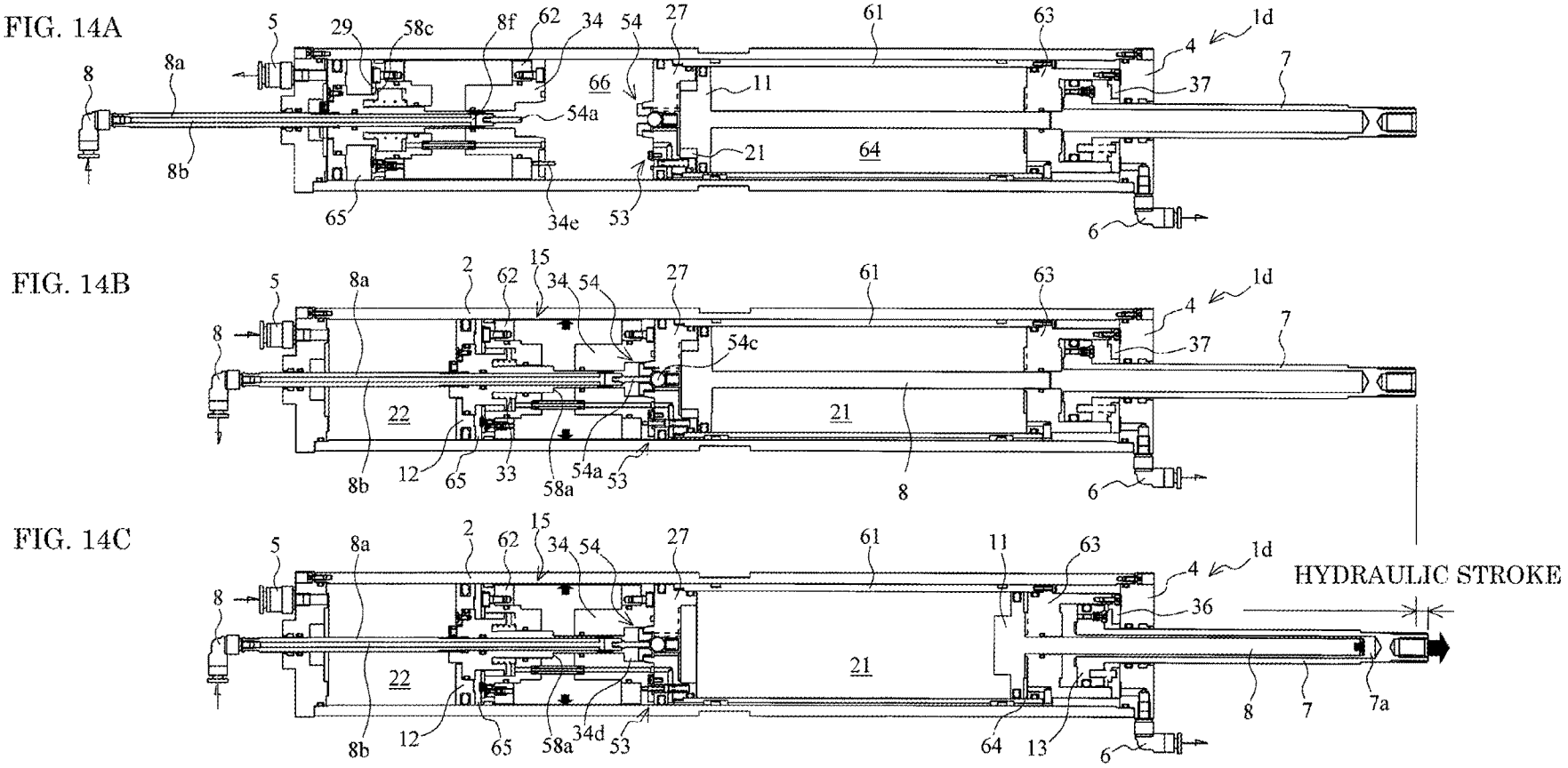
FIGS. 14A to 14C are views for illustrating a state of second actuation of the fourth embodiment.

(3) Actuation from a state in FIGS. 13E and 14C.

FIGS. 13E and 14C illustrate a state after the second housing 62 is fixed and the air is supplied to the first pneumatic chamber 21.

(i) In this state, the third inlet/outlet 8 is opened while the first inlet/outlet 5 maintains the pressurizing state, and the air is simultaneously supplied from the second inlet/outlet 6 with the predetermined pressure. At this time, supply pressure from the second inlet/outlet 6 is lower than supply pressure of the first inlet/outlet 5.

(ii) The pressure of the third pneumatic chamber 41 causes the third piston 13 to move to the input side because the pressure is also applied to the third piston 13, and the first piston 11 is to move to the input side since the oil in the first hydraulic chamber 31 is to return to the original state. Simultaneously, since the air is also supplied to the fourth pneumatic chamber 64, the pressure is increased and the first piston 11 is caused to move to the input side.

At this point, since the second piston 12 does not move, the check valve 54 is released as it is. Since the pressure is higher in the second pneumatic chamber 22 than in the fifth pneumatic chamber 65, and a sectional area of the second piston 12 on the side of the second pneumatic chamber 22 is larger than in the other pneumatic chambers, the second piston 12 does not move to the input side even when the pressure of the fifth pneumatic chamber 65 is increased. The movement of the first piston 11 can be checked by detecting a discharge amount of the air from the third inlet/outlet 8 or detecting a positional change of the output rod 7.

(iii) Open the first inlet/outlet 5 while the air is supplied from the second inlet/outlet 6. The actuation from here on is the same as that in a case where the state in FIG. 13D returns to the initial state.

Since the second piston 12 and the rod portion 58 do not receive the pneumatic pressure in the output direction by the second pneumatic chamber 22, the second piston 12 and the rod portion 58 are biased in the input direction by the pressurization to the fifth pneumatic chamber 65 and the coil spring 33 and starts to move.

(iv) Since the third pneumatic chamber 41 and the fourth pneumatic chamber 64 are already pressurized and a force is applied thereto such that the first housing 61 moves to the input side, the second housing 62 is released from the fixing (clamping) by the thin portion 15 of the second housing 62 and, simultaneously, the first housing 61 and the second housing 62 integrally move to the input side (while the lid 27 and the lid 34 are in close contact with each other). At this time, since the second housing 62 starts moving when the second housing 62 is released from the fixing, there may be no need to wait until the flange 58*c* abuts on the retaining ring 29.

In addition, actuation after the state in which the second housing 62 is released from the fixing (clamping) is the same as that in a case where the state of FIG. 13C returns to the initial state.

(v) The second piston 12 abuts on the lid 3 and is stopped.

(vi) Since the entire movement is ended, the air supply from the second inlet/outlet 6 is stopped and the second inlet/outlet 6 is opened. The coil spring 33 biases the second housing 62 to the output side while the second piston 12 abuts on the lid 3, the second housing 62 moves to the output side until the flange 58*c* abuts on the retaining ring 29, and the state returns to the initial state.

As illustrated in FIG. 12B, in the initial state, while the first inlet/outlet 5 is released, the second inlet/outlet 6 is opened and the supply of the air from the third inlet/outlet 8 is started.

Then, an air hydraulic mechanism portion moves to the output side by air drive from the third inlet/outlet 8. In other words, the air from the third inlet/outlet 8 pressurizes the moving pneumatic chamber 66 through the inlet/outlet channel 8*b* and the communication channel 8*f* of the inlet/outlet rod 8*a*, and the communication hole 34*d*, and thereby the lid 27, the first housing 61, the first piston 11, the rod portion 50, the third housing 63, the third piston 13, the output rod 7, and the retaining ring 37*a* move to the output side.

Then, FIG. 12B illustrates a state in which the front end portion of the output rod 7 abuts on the workpiece 100 and the movement of the output-side housings (61 and 63) is stopped. It is determined that the front end of the output rod 7 abuts on the workpiece 100, when the movement of the output rod 7 is stopped or the pneumatic pressure of the moving pneumatic chamber 66 detected by a pressure sensor exceeds a predetermined value.

Since the air is not supplied from the first inlet/outlet 5, the pneumatic pressure of the second pneumatic chamber 22 is not increased, the first piston 11 and the rod portion 50 do not move in the output direction, and the second housing 62 and the second hydraulic chamber 32 do not move. If the third inlet/outlet 8 is opened from this state and the air is supplied from the second inlet/outlet 6, the state returns to the initial state. When the initial state and the state in FIG. 12B are only repeated, the cylinder can be used as a normal pneumatic cylinder.

Next, as illustrated in FIG. 13C, after the front end of the output rod 7 abuts on the workpiece 100, the third inlet/outlet 8 that supplies the air is opened, and the air is supplied from the first inlet/outlet 5 while the second inlet/outlet 6 is opened.

Then, the pressure of the second pneumatic chamber 22 is increased and the internal volume is increased, and the second piston 12 and the rod portion 58 move to the output side. In addition, the rod portion 58 pushes the lid 39 via the coil spring 33, and thereby the second housing 62 and the second hydraulic chamber 32 also move in the output direction.

When the second housing 62 moves and the lid 34 abuts on the lid 27, the front end of the output rod 7 abuts on the workpiece 100, and thereby the movement of the second housing 62 is stopped, along with the first housing 61 of which the movement is already stopped. In other words, the movement of all of the piston housings 60 (61, 62, and 63) is stopped, and the cylinder device comes into the state in FIG. 13C.

As illustrated in FIG. 13C, in this state, the on-off valve 53 comes into the opened state, and the check valve 54 comes into the closed state.

As illustrated in FIG. 13D, in a state in which the movement of all of the piston housings 60 is stopped, the pressure in the second pneumatic chamber 22 exceeds the bias force by the coil spring 33, and the second piston 12 and the rod portion 58 move in the output direction when the air is further supplied from the first inlet/outlet 5.

In this manner, the second hydraulic chamber 32 is pressed by the step 58*a*, and the internal pressure is increased. The thin portion 15 is elastically deformed to the outer side, and all of the piston housings 60 comes into a state of being fixed (clamped) to the cylinder 2 from a state in which the movement is stopped.

Regarding whether or not the piston housing 60 is fixed to the cylinder 2 due to the elastic deformation of the thin portion 15, a strain gauge (not illustrated) is disposed on the outer circumference of the cylinder 2, deformation strain of the cylinder 2 due to the pressing force by the thin portion 15 to the cylinder 2 is detected, and the fixing of the piston housing 60 is determined by detecting a predetermined amount of strain. Otherwise, a pressure sensor (not illustrated) that detects pressure in the second hydraulic chamber 32 may be disposed, and determination may be performed by whether or not the pressure exceeds a predetermined value (value of the elastic deformation of the thin portion 15). A detection target by the pressure sensor may be the second pneumatic chamber 22. In addition, instead of the pressure sensor, a sensor that detects the movement of the output rod 7 or a sensor that detects the movement of the inlet/outlet rod 8*a* may be provided, and determination of fixing may be performed after a predetermined period of time (a period of time until the pressure of the second hydraulic chamber is increased and the thin portion 15 is elastically deformed) elapses from the stop of the movement.

Immediately after the piston housing 60 is fixed, the opening/closing rod 54*a* fixed to the front end of the rod portion 58 presses the spherical body 54*c*, the spherical body 54*c* is separated from the stop ring 54*b*, and thereby the check valve 54 is opened (the state in FIG. 13D).

Due to the movement of the second piston 12 and the rod portion 58, the volume in the communication hole 34*d* connected to the moving pneumatic chamber 66 is also decreased. The air in the communication hole 34*d* is discharged from the third inlet/outlet 8 through the communication channel 8*f* and the inlet/outlet channel 8*b* when the description is provided with reference to FIG. 13C for the convenience of notation on the figures.

On the other hand, the volume of the fifth pneumatic chamber 65 also decreases due to the movement of the second piston 12; however, the air in the fifth pneumatic chamber 65 moves to the third pneumatic chamber 41 and is discharged from the second inlet/outlet 6. As a specific path, a path through which the air is discharged from the fifth pneumatic chamber 65 through the recessed portion 39*d*, the communication hole 39*c*, the collar 28, the communication hole 34*b*, the communication hole 27*h*, the communication groove 61*e*, the groove 63*c*, and the third pneumatic chamber 41 to the second inlet/outlet 6 (refer to FIG. 13C).

After the fixing (clamping) of the piston housing 60 is detected, as illustrated in FIG. 13E, while the supply of the air from the first inlet/outlet 5 is continued, the air is supplied from the third inlet/outlet 8.

The air from the third inlet/outlet 8 reaches the communication hole 34*d* through the inlet/outlet channel 8*b* and the communication channel 8*f* of the inlet/outlet rod 8*a* and increases the pressure of the first pneumatic chamber 21 through the check valve 54 that is in the opened state, the communication hole 27*b*, and the communication groove 27*d*.

Then, the first piston 11 receives the pressure of the first pneumatic chamber 21, the front end of the rod portion 50 presses the first hydraulic chamber 31, and the third piston 13 receives the amplified hydraulic pressure. The third piston 13 receives the amplified hydraulic pressure such that the large thrust is output from the output rod 7 to the workpiece 100.

Second Actuation

Next, second actuation from the initial state illustrated in FIG. 12A is described.

FIGS. 14A to 14C illustrate states of the second actuation performed by the cylinder device 1*d*.

In the second actuation, the end portion (retaining ring 37*a*) of the piston housing 60 on the output side abuts on the lid 4 before the front end of the output rod 7 abuts on the workpiece 100, and thereby fixing of the piston housings 60 is formed. Then, the amplified hydraulic pressure is output from the front end of the output rod 7 at any timing.

As illustrated in FIG. 14A, in the initial state, while the first inlet/outlet 5 is opened, the second inlet/outlet 6 is opened and the air is supplied from the third inlet/outlet 8.

Then, the air hydraulic mechanism portion moves to the output side by air drive from the third inlet/outlet 8. In other words, the air from the third inlet/outlet 8 pressurizes the moving pneumatic chamber 66 through the inlet/outlet channel 8*b* and the communication channel 8*f* of the inlet/outlet 8*a*, and the communication hole 34*d*, and thereby the lid 27, the first housing 61, the first piston 11, the rod portion 50, the third housing 63, the third piston 13, the output rod 7, and the retaining ring 37*a* move to the output side.

Unlike the first actuation in which the front end of the output rod 7 abuts on the workpiece 100 such that the movement of the output-side housings (61 and 63) is stopped, the retaining ring 37*a* abuts on the lid 4, and thereby the movement of the output-side housings (61 and 63) are stopped in the second actuation.

Similar to the first actuation, the stopping of the output-side housings (61 and 63) is determined whether the movement of the output rod 7 is stopped or the pneumatic pressure of the moving pneumatic chamber 66 detected by a pressure sensor exceeds a predetermined value.

As illustrated in FIG. 14B, in a state in which movement stop of the output-side housings (61 and 63) is detected, the third inlet/outlet 8 is changed into the opened state, and the air is supplied from the first inlet/outlet 5.

Then, the pressure of the second pneumatic chamber 22 is increased and the internal volume is increased, the second piston 12 and the rod portion 58 and the second housing 62 and the second hydraulic chamber 32 move in the output direction, and the lid 34 abuts on the lid 27. In association with the movement, the air in the moving pneumatic chamber 66 is discharged from the third inlet/outlet 8 through the inlet/outlet channel 8*b* from the communication channel 8*f*. The lid 34 abuts on the lid 27, and thereby the moving pneumatic chamber 66 has the minimum volume. When the lid 34 abuts on the lid 27, the on-off valve 53 comes into the opened state and the check valve 54 comes into the closed state.

Similar to FIG. 14A, when the lid 34 abuts on the lid 27, the rod portion 58 comes into a state in which the flange 58*c* abuts on the retaining ring 29, due to the bias force of the coil spring 33, and the volume of the fifth pneumatic chamber 65 is the same as that in the initial state.

After the lid 34 abuts on the lid 27, the rod portion 58 further moves in the output direction against the coil spring 33, and the internal pressure of the second hydraulic chamber 32 is increased by the step 58*a* when the air is further supplied from the first inlet/outlet 5. The piston housing 60 is fixed (clamped) to the cylinder 2 due to the elastic deformation of the thin portion 15.

On the other hand, the opening/closing rod 54*a* on the front end of the inlet/outlet 8*a* pushes the spherical body 54*c*, and thereby the check valve 54 comes into the opened state.

As illustrated in FIG. 14C, the air is supplied from the third inlet/outlet 8 while the air supply from the first inlet/outlet 5 is maintained.

Then, the supplied air from the third inlet/outlet 8 is supplied to the communication hole 34*d* through the inlet/outlet channel 8*b* and the communication channel 8*f* and increases the pressure the pressure of the first pneumatic chamber 21 further through the on-off valve 53 that is in the opened state. The first piston 11 receives the increased pressure, and thereby the front end of the rod portion 50 presses the first hydraulic chamber 31.

However, since the output rod 7 is in a free state in which the output rod does not abut on the workpiece 100 or the like, the third piston 13 and the output rod 7 can move in the output direction. Therefore, the first piston 11 and the rod portion 50 move in the output direction and enter the cavity 7*a* of the output rod 7 due to the pressure of the first pneumatic chamber 21 while the front end of the rod portion 50 presses the first hydraulic chamber 31.

In this manner, the oil in the cavity 7*a* moves to the side of the recessed portion 63*a* of the first hydraulic chamber 31 through a space between the outer circumferential surface of the rod portion 50 and the inner circumferential surface of the output rod 7. The third piston 13 moves in the output direction due to the movement of the oil in the first hydraulic chamber 31 to a distance in proportion to a length of a stroke of the insertion of the rod portion 50 into the inside of the first hydraulic chamber 31.

In this state, the third piston 13 receives the hydraulic pressure increased due to the pressing of the first hydraulic chamber 31 by the front end of the rod portion 50, and thereby the large thrust is output from the front end of the output rod 7.

When Lh represents a movement distance (hydraulic stroke) of the output rod 7 until the rod portion 50 moves in the cavity 7*a* and the thrust is output from the output rod 7, La represents a length of a stroke of the insertion of the rod portion 50 into the inside of the first hydraulic chamber 31 (=movement distance of the first piston 11), Sa represents a sectional area of the rod portion 50 on the output side in the first hydraulic chamber 31, and Sh represents a sectional area of the third piston 13 and the output rod 7 on the input side in the first hydraulic chamber 31. A relationship of the following expression is satisfied.

$$Lh=La\times(Sa/Sh)$$

As described above, in the fourth embodiment, the input-side housing (62) and the output-side housings (61 and 63) are configured to be separated from each other in an independently movable manner. Then, the third inlet/outlet 8 for generating the thrust from the front end of the output rod 7 is provided, separately from the first inlet/outlet 5 for increasing the hydraulic pressure of the second hydraulic chamber 32 so as to fix the piston housing 60 to the cylinder 2.

In this manner, it is possible to perform the clamping actuation of fixing the piston housing 60 to the cylinder 2 independently from the thrust generating actuation from the front end of the output rod 7.

In addition, a reciprocating motion can be performed with the air inside the cylinder only by the piston housing 60, and the cylinder device can also be used as a general air cylinder.

In the fourth embodiment, the strain gauge is disposed on the outer circumference of the cylinder 2, the deformation strain of the cylinder 2 due to the pressing force by the thin portion 15 to the cylinder 2 is detected, and the fixing of the piston housing 60 is determined; however, also similar to the first to third embodiments, the strain gauge may be disposed and whether or not the piston housing 14 is fixed due to the elastic deformation of the thin portion 15 may be determined.

Also in the fourth embodiment described above, it is possible to achieve effects of the first to third embodiments described above.

In addition, in the fourth embodiment described above, the case where the piston housing 60 is fixed to the cylinder 2 with the thin portion 15 of the second housing 62 is described; however, similar to the third embodiment described in FIGS. 9A to 9D, the piston housing 60 may be fixed to the cylinder 2 by the clamper.

In addition, also in the fourth embodiment, similar to the description in FIGS. 5AA to 5CD, it is possible to perform punching or forming a recessed portion by the press working.

What is claimed is:

1. A cylinder device comprising:

a cylinder;

a hydraulic chamber that moves in a thrust direction in the cylinder, wherein the hydraulic chamber includes a first hydraulic chamber and a second hydraulic chamber;

a transfer pneumatic chamber that is formed in the cylinder and transfers the hydraulic chamber from an input side of the cylinder device to an output side of the cylinder device;

a pressurizing pneumatic chamber that is formed in the cylinder and pressurizes the hydraulic chamber; and an output rod that outputs amplified hydraulic pressure that is generated in the first hydraulic chamber by pressurizing the first hydraulic chamber, wherein the cylinder device is configured to:

generate a first force in a radial direction by pressurizing the hydraulic chamber; and fix the first hydraulic chamber and the second hydraulic chamber using the first force.

2. The cylinder device according to claim 1, wherein the hydraulic chamber is configured to:

generate hydraulic pressure using the first force at the output side and using a second force at the input side that is applied to the hydraulic chamber by the output rod.

3. The cylinder device according to claim 1, wherein the cylinder device is configured to fix the second hydraulic chamber and the first hydraulic chamber by pressing, to an inner wall of the cylinder, a side wall of the second hydraulic chamber that is elastically deformed using the first force in the radial direction.

4. The cylinder device according to claim 1, wherein the cylinder device is configured to:

generate a third force in the radial direction by pressing, to a clamper, a taper member moving in the thrust direction using hydraulic pressure of the second hydraulic chamber, and fix the second hydraulic chamber and the first hydraulic chamber by pressing the clamper to an inner wall of the cylinder using the third force.

5. The cylinder device according to claim 1, wherein the first hydraulic chamber has an output piston pressing the output rod toward the output side, the cylinder device further comprising:

biasing means that biases the output piston in a direction opposite to the output side.

6. The cylinder device according to claim 5, wherein the output piston of the first hydraulic chamber transmits only an output to the output rod without moving even in a state in which the amplified hydraulic pressure is applied to the output rod and thrust is output.

7. The cylinder device according to claim 1, further comprising:

an input-side housing that moves in the thrust direction in the cylinder;

an output-side housing that is separated from the input-side housing to be disposed on the output side, wherein the first hydraulic chamber is disposed in the output-side housing and is provided with the output rod and the second hydraulic chamber is disposed in the input-side housing, wherein the pressurizing pneumatic chamber includes a first pneumatic chamber having a first piston that pressurizes the first hydraulic chamber and a second pneumatic chamber having a second piston that pressurizes the second hydraulic chamber, and wherein the transfer pneumatic chamber is disposed between the first hydraulic chamber and the second hydraulic chamber so as to transfer the first hydraulic chamber from the input side to the output side.

8. The cylinder device according to claim 7, wherein the second piston has a rod portion that moves to the output side due to pressure from the second pneumatic chamber and pressurizes the second hydraulic chamber due to the movement, wherein the cylinder device is configured to:

fix the second hydraulic chamber by generating the first force in the radial direction due to hydraulic pressure of the second hydraulic chamber that is pressurized by the rod portion to restrict the first hydraulic chamber from moving to the input side.

9. The cylinder device according to claim 7, further comprising:

a first inlet/outlet for pressurizing the second pneumatic chamber; and a third inlet/outlet for pressurizing the transfer pneumatic chamber by penetrating through the second pneumatic chamber and the second hydraulic chamber.

10. The cylinder device according to claim 7, wherein the second piston has a rod portion that moves to the output side due to pressure from the second pneumatic chamber and pressurizes the second hydraulic chamber due to the movement.

11. The cylinder device according to claim 10, wherein the third inlet/outlet has an inlet/outlet rod that is fixed to the second piston, penetrates through the second piston and the rod portion, and penetrates through the second pneumatic chamber and the second hydraulic chamber so as to pressurize the transfer pneumatic chamber, wherein the cylinder device further comprises:

a valve mechanism that is disposed on a communication channel, through which the transfer pneumatic chamber and the first pneumatic chamber are connected to each other, and the valve mechanism is in an opened state or in a closed state depending on movement of the inlet/outlet rod moving along with the second piston, and wherein the third inlet/outlet pressurizes the transfer pneumatic chamber when the valve mechanism is in the closed state and pressurizes the first pneumatic chamber when the valve mechanism is in the opened state.

12. A cylinder device actuating method for actuating the cylinder device according to claim 11, the method comprising:

a first movement stopping step of stopping the movement of the output-side housing by pressurizing the transfer pneumatic chamber from the third inlet/outlet and causing the output-side housing to move to the output side and the output rod to abut on a workpiece or causing an output-side end portion of the output-side housing to abut on an end portion of the cylinder on the output side;

a second movement stopping step of causing the second piston and the input-side housing to move to the output side and stopping the movement with abutment on the output-side housing by pressurizing the second pneumatic chamber from the first inlet/outlet;

a fixing step of pressurizing the second pneumatic chamber from the first inlet/outlet so as to cause the second piston to further move to the output side such that the rod portion pressurizes the second hydraulic chamber of the input-side housing subjected to the stopping of the movement, fixing the input-side housing and the output-side housing to the cylinder, and causing the valve mechanism to come into the opened state; and a thrust generating step of pressurizing the first pneumatic chamber from the third inlet/outlet through the valve mechanism being in the opened state and generating thrust due to the hydraulic pressure amplified from a front end of the output rod.

13. The cylinder device according to claim 1, wherein the pressurizing pneumatic chamber includes a first pneumatic chamber having a first piston that pressurizes the first hydraulic chamber, a second pneumatic chamber having a second piston that pressurizes the second hydraulic chamber, and a communication hole through which the first pneumatic chamber communicates with the second pneumatic chamber, and wherein the first pneumatic chamber has a first inlet/outlet and is formed on the input side.

14. The cylinder device according to claim 13, wherein the first piston causes the second pneumatic chamber, the first hydraulic chamber, and the second hydraulic chamber to move to the output side until the output rod abuts on a workpiece or until the first hydraulic chamber reaches an end portion on the output side to which the first hydraulic chamber is movable, with pressure of the first pneumatic chamber.

15. The cylinder device according to claim 14, wherein a movement distance of the second piston is set within a range of a length of elastic deformation of a seal member of the second hydraulic chamber, wherein the movement distance of the second piston is measured when the second piston generates the hydraulic pressure of the second hydraulic chamber.

16. The cylinder device according to claim 14, wherein the first hydraulic chamber is formed on the output side, and wherein the first piston is formed on the first hydraulic chamber by penetrating through the second pneumatic chamber and the second hydraulic chamber.

17. The cylinder device according to claim 16, wherein the communication hole and a piston rod of the first piston are separable between the first pneumatic chamber and the second pneumatic chamber such that the communication hole is separated into a first communication hole and a second communication hole, and the piston rod is separated into a first piston rod and a second piston rod, and wherein the transfer pneumatic chamber is formed between the first pneumatic chamber and the second pneumatic chamber and separates the second pneumatic chamber from the first pneumatic chamber so as to transfer the second pneumatic chamber along with the first hydraulic chamber and the second hydraulic chamber to the other end side.

18. The cylinder device according to claim 17, wherein the communication hole is formed to penetrate through the first piston, and wherein the first pneumatic chamber transfers the first piston to the side of the second pneumatic chamber such that the first communication hole joins the second communication hole, and the first piston rod joins the second piston rod.

19. The cylinder device according to claim 18, wherein the communication hole has a valve mechanism in a separating portion, and wherein the valve mechanism is configured to:

stop circulation from the transfer pneumatic chamber formed between the first pneumatic chamber and the second pneumatic chamber to the second pneumatic chamber when the first communication hole is separated from the second communication hole; and perform the circulation between the first pneumatic chamber and the second pneumatic chamber when the first communication hole joins the second communication hole.

20. The cylinder device according to claim 18, further comprising:

a second inlet/outlet formed on the input side; and a transfer inlet/outlet channel that communicates with the second inlet/outlet and the transfer pneumatic chamber, is formed inside the first piston and the piston rod of the first piston, and elongates and contracts depending on the movement of the first piston.

21. The cylinder device according to claim 20, wherein the transfer inlet/outlet channel elongates and contracts in the cylinder.

22. The cylinder device according to claim 20, wherein the transfer inlet/outlet channel extends to the outside of the cylinder and elongates and contracts with an extending portion sliding inside and outside the cylinder.

23. The cylinder device according to claim 20, further comprising:

a third pneumatic chamber that is provided on the output side, has a third inlet/outlet, and presses the first hydraulic chamber and the second hydraulic chamber to the input side.

24. A cylinder device actuating method for actuating the cylinder device according to claim 23, the method comprising:

a first step of setting an initial state by causing the first hydraulic chamber and the second hydraulic chamber to move to the input side by pressurizing the third inlet/outlet and depressurizing the first inlet/outlet and the second inlet/outlet;

a second step of causing the output rod to abut on the workpiece or causing the first hydraulic chamber to reach an end portion on the output side to which the first hydraulic chamber is movable by causing the first pneumatic chamber and the second pneumatic chamber to move to the output side by pressurizing the first pneumatic chamber and the second pneumatic chamber from the first inlet/outlet and depressurizing the third pneumatic chamber from the second inlet/outlet;

a third step of fixing the first hydraulic chamber and the second hydraulic chamber to the cylinder by depressurizing the second inlet/outlet and the third inlet/outlet and pressurizing the first inlet/outlet so as to pressurize the second pneumatic chamber;

a fourth step of pressing the output rod to the workpiece by further performing pressurization from the first inlet/outlet and amplifying the hydraulic pressure; and a fifth step of returning to the initial state by causing the first hydraulic chamber and the second hydraulic chamber to move to the input side by depressurizing the first inlet/outlet and the second inlet/outlet and pressurizing the third inlet/outlet.

25. A press machine comprising:

the cylinder device according to claim 23 having the output rod on which a tool is disposed; and workpiece mounting means for mounting the workpiece at a predetermined position with respect to the cylinder device, wherein the press machine is configured to:

press the mounted workpiece with the tool by driving the cylinder device; and detach the pressed workpiece from the predetermined position.

26. A method for pressing the workpiece by actuating the press machine according to claim 25, the method comprising:

a first step of driving the cylinder device and returning a position of the output rod to an initial state;

a second step of mounting the workpiece at a predetermined position;

a third step of moving the output rod by the pressure of the first pneumatic chamber, until the tool disposed on the output rod abuts and stops on the workpiece or until the first hydraulic chamber reaches and stops on the end portion on the output side to which the first hydraulic chamber is movable;

a fourth step of fixing the first hydraulic chamber and the second hydraulic chamber;

a fifth step of amplifying hydraulic pressure of the first hydraulic chamber;

a sixth step of pressing the workpiece using hydraulic pressure generated by the tool and using the hydraulic pressure amplified in the fifth step;

a seventh step of detaching the output rod and the tool disposed on the output rod from the workpiece due to pneumatic pressure; and an eighth step of detaching the pressed workpiece from the predetermined position.

27. A workpiece clamping apparatus comprising:

the cylinder device according to claim 23 having the output rod on which a tool is disposed; and workpiece mounting means for mounting the workpiece at a predetermined position with respect to the cylinder device, wherein the workpiece clamping apparatus is configured to:

press and clamp the mounted workpiece with the tool by driving the cylinder device; and detach the clamped workpiece from the predetermined position.

28. A method for clamping a workpiece at a predetermined position by actuating the workpiece clamping apparatus according to claim 27, the method comprising:

a first step of mounting the workpiece at the predetermined position;

a second step of moving the output rod by the pressure of the first pneumatic chamber, until the tool disposed on the output rod abuts and stops on the workpiece or until the first hydraulic chamber reaches and stops at the output side to which the first hydraulic chamber is movable;

a third step of fixing the first hydraulic chamber and the second hydraulic chamber;

a fourth step of amplifying hydraulic pressure of the first hydraulic chamber; and a fifth step of clamping the workpiece at the predetermined position by pressing the workpiece with the tool disposed on the output rod due to the hydraulic pressure amplified in the fourth step.

* * * * *